US005331375A

United States Patent [19]

Ito

[11] Patent Number: 5,331,375

[45] Date of Patent: Jul. 19, 1994

[54] IMAGE FORMING APPARATUS FOR WRITING A PLURALITY OF ADDITIONAL DATA ON A SINGLE COPY SHEET

[75] Inventor: Masazumi Ito, Toyohashi, Japan

[73] Assignee: Minolta Camera Kabushiki Kaisha, Osaka, Japan

[21] Appl. No.: 875,188

[22] Filed: Apr. 29, 1992

[30] Foreign Application Priority Data

May 9, 1991 [JP] Japan ..... 3-104156

[51] Int. Cl.[5] ..... G03G 21/00; G03G 15/00

[52] U.S. Cl. ..... 355/202; 355/308; 355/309; 355/313; 355/321

[58] Field of Search ..... 355/244, 218, 202, 308, 355/309, 313, 314, 321, 40

[56] References Cited

U.S. PATENT DOCUMENTS

| | | | |
|---|---|---|---|
| 4,708,469 | 11/1987 | Bober et al. | 355/77 |
| 4,814,822 | 3/1989 | Acquaviva et al. | 355/244 |
| 4,831,413 | 5/1989 | Hamakawa | 355/313 |
| 4,845,525 | 7/1989 | Ito | 355/218 |
| 4,914,472 | 4/1990 | Hamakawa | 355/313 X |
| 4,922,294 | 5/1990 | Nakagami et al. | 355/209 |
| 4,958,198 | 9/1990 | Hamakawa | 355/309 |
| 4,963,920 | 10/1990 | Fukushima | 355/50 |
| 5,006,904 | 4/1991 | Matsuo et al. | 355/313 |
| 5,021,832 | 6/1991 | Fukushima | 355/218 |
| 5,065,181 | 11/1991 | Ito | 355/202 |
| 5,077,577 | 12/1991 | Hamakawa | 355/244 |

FOREIGN PATENT DOCUMENTS

| | | | |
|---|---|---|---|
| 0143785 | 7/1986 | Japan | 355/202 |

*Primary Examiner*—Matthew S. Smith

*Attorney, Agent, or Firm*—Burns, Doane, Swecker & Mathis

[57] ABSTRACT

A copying apparatus capable of copying the images of a plurality of original documents onto the same surface of a single copy sheet. The aforesaid copying apparatus is capable of writing the date, page number and like additional data on the same surface of a single copy sheet as the original document images. The additional data is written at positions corresponding to the original document images, and when two original document images are copied onto the same surface of a single copy sheet, the additional data is written at positions corresponding to the respective document images.

20 Claims, 29 Drawing Sheets

IMAGE FORMING APPARATUS FOR WRITING A PLURALITY OF ADDITIONAL DATA ON A SINGLE COPY SHEET

BACKGROUND OF THE INVENTION

1. FIELD OF THE INVENTION

The present invention relates to an image forming apparatus capable of forming a plurality of images on a single copy sheet, and more specifically relates to an image forming apparatus capable of writing additional data together with said plurality of images.

2. DESCRIPTION OF THE RELATED ART

When original documents are copied by copying apparatus, a single original document is normally copied on a single copy sheet, whereas when the two-document single-sided copy mode (two-in-one mode) is set, two separate original documents are copied side by side onto a single copy sheet so as to save paper consumption, adjust for paper type and the like. U.S. Pat. No. 5,006,904 discloses a copying apparatus which accomplishes the aforementioned process. Furthermore, copying apparatus have been proposed which have various composite mode functions such as four-document single-sided copy (four-in-one mode) and eight-document single-sided copy (eight-in-one mode) functions.

Means for data copying, such as when copying the date or other additional data onto a copy sheet is desired, have been disclosed in, for example, U.S. Pat. No. 4,845,525.

Conventional means for copying additional data copy the additional data at a single location on the copy sheet. This type of data copying means is used in copying apparatus provided with a composite mode function such as the previously described two-in-one mode function. In the composite mode, wherein a plurality of original documents are copied on a single-sided copy sheet, the aforesaid additional data can be copied only to a single location on the copy sheet.

Composite mode copying concerns the copying of a plurality of original document images onto a single side of a single copy sheet. Copying data such as page numbers or the like corresponding to each original document onto the copy sheet for ease of handling of the copies is desirable, but unavailable.

SUMMARY OF THE INVENTION

A main object of the present invention is to provide an image forming apparatus capable of forming a plurality of images and a plurality of additional data on a single copy sheet.

A further object of the present invention is to provide an image forming apparatus capable of forming a plurality of images on a single copy sheet, said image forming apparatus being capable of forming additional data for each of said plurality of images.

PREFERRED EMBODIMENT OF THE PRESENT INVENTION

The preferred embodiment of the present invention is described hereinafter with reference to the accompanying drawings.

Figure 1:
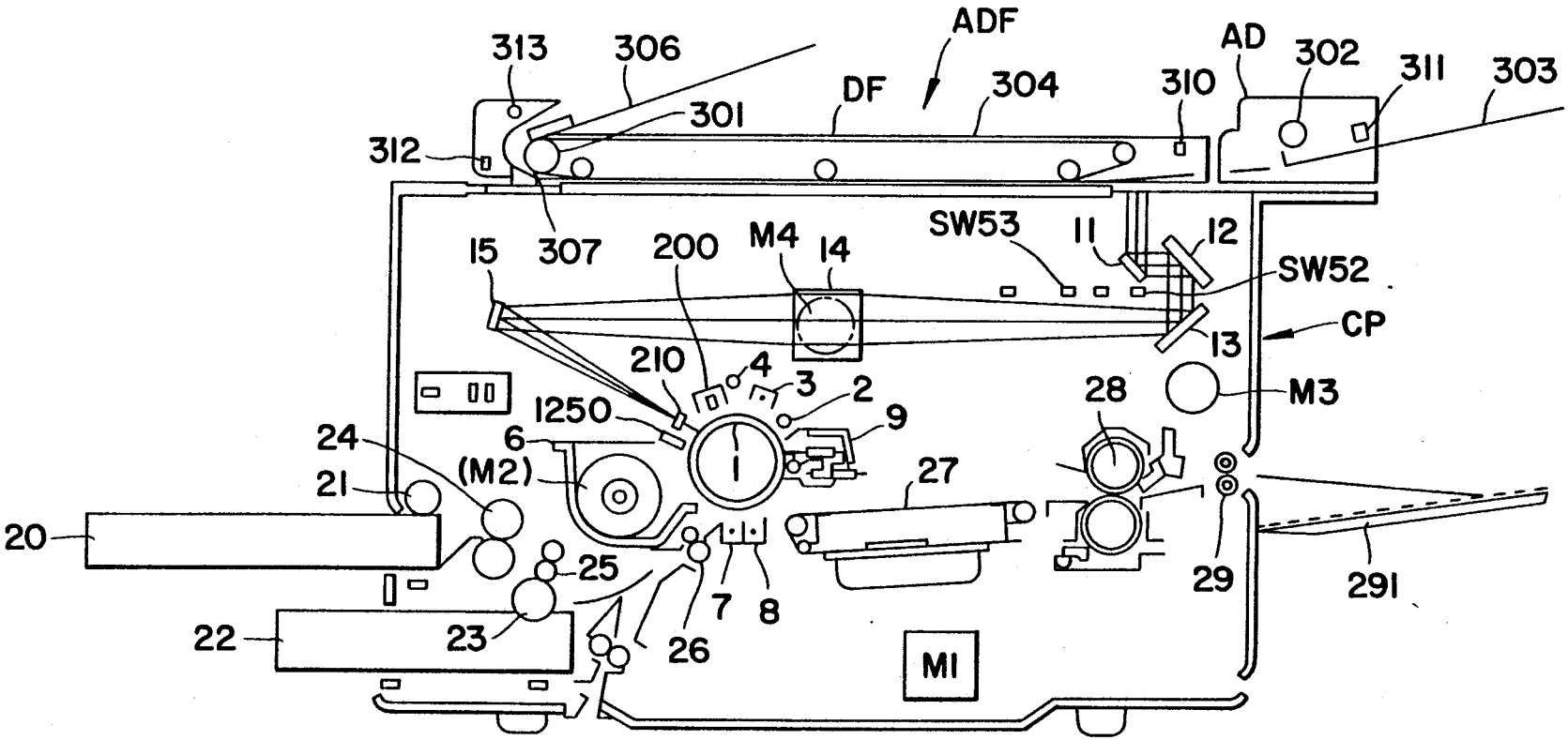
FIG. 1 is a section view of the construction of a copying apparatus.

FIG. 1 shows an example of the copying apparatus of the present invention. A photosensitive drum 1 which is rotatably driven in the counterclockwise direction is provided in the center of the copying apparatus body CP, and arranged around the photosensitive drum 1 are eraser lamp 2, charger 3, developing device 6, transfer charger 7, copy sheet separation charger 8, and blade-type cleaning device 9. The photosensitive drum 1 is rotatably driven by the main motor M1, and is receives an electric charge by passing the eraser lamp 2 and charger 3, and is exposed to the image projected by the optical system 10. The aforesaid image exposure light forms an electrostatic latent image on the surface of the photosensitive drum 1 which is subsequently developed via the developing device 6 driven by the developing motor M2 so as to produce a toner image.

The optical system 10 scans the original document image from beneath the glass document platen 16, and comprises a light source (not shown in the drawing), movable mirrors 11, 12 and 13, lens 14, and mirror 15. The light source and movable mirror 11 are driven by the DC scan motor M3. When the copy magnification is changed, the lens 14 is moved on its optical axis via a lens controlling motor M4 in conjunction with the moving/oscillation operation of the mirror 15. The switch SW52 is an erase switch, and the switch SW53 is an image leading edge switch.

The liquid crystal shutter 210 is provided in the optical path from the mirror 15 to the photosensitive drum 1 so as to open and close the optical path.

The inter-image eraser unit 200 and the LED writing device 250 are provided in the vicinity of the photosensitive drum 1.

On the other hand, paper supply portions 20 and 22 with feed rollers 21 and 23 are respectively provided on the left side of the copying apparatus. The copying apparatus transport path comprises roller sets 24 and 25, a pair of timing rollers 26, fixing device 28, and a pair of discharge rollers 29. Item 291 is a discharge tray. The aforesaid transport system is driven by the main motor M1.

An automatic document feeder (ADF) is provided on the top of the copying apparatus CP, said ADF combining an original document feeder DF for transporting original documents to the exposure portion, and an automatic document supply device AD for automatically transporting original documents to the document feeder DF.

When the print key 71 provided on the copying apparatus is turned ON, the motor 302 for the document feed rollers and the transport motor 301 for the transport belt 304 begin operation, the original document disposed on the document tray 303 is fed along the upper surface of the glass document platen 16 such that the original stops at a predetermined position a predetermined period after the leading edge of the original passes the document sensor 310. When the final scan of the aforesaid original document has ended, the ADF discharges the document onto the discharge tray 306. The document sensor 311 detects whether or not an original document is placed in the document tray 303. The document discharge sensor 313 detects the discharge of the original document to the discharge tray 306.

Figure 2:
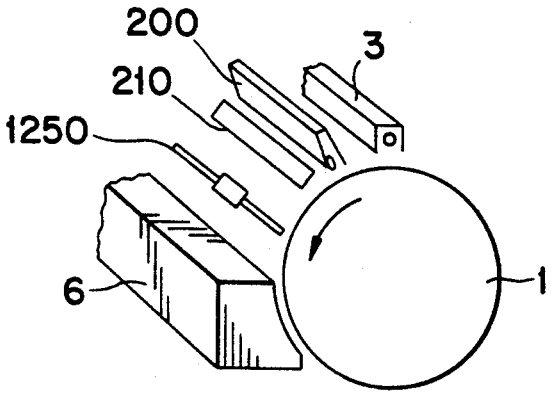
FIG. 2 is a perspective view of the additional data copying device and its surroundings.

FIG. 2 shows the portion of the copying apparatus related to the data writing device. In the drawing, item 200 is an image interval erasing unit for image interval erasing or side erasing in accordance with the copy magnification. Item 210 is an optical path shutter for shielding the image exposure from the optical system 10, and item 1250 is an LED writing device.

Figure 3:
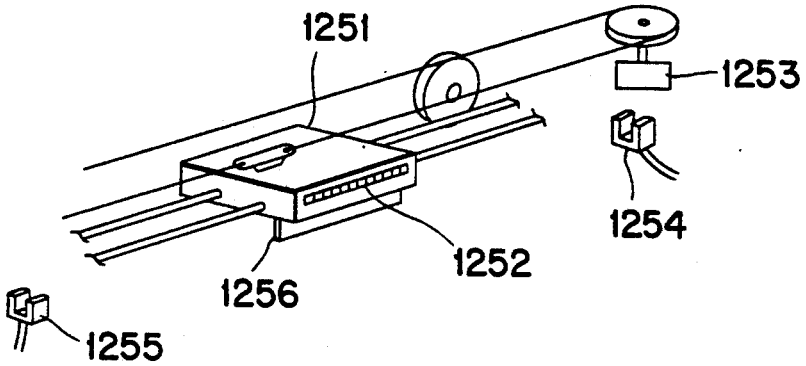
FIG. 3 is an illustration showing details of the additional data copying device.
Figure 4:
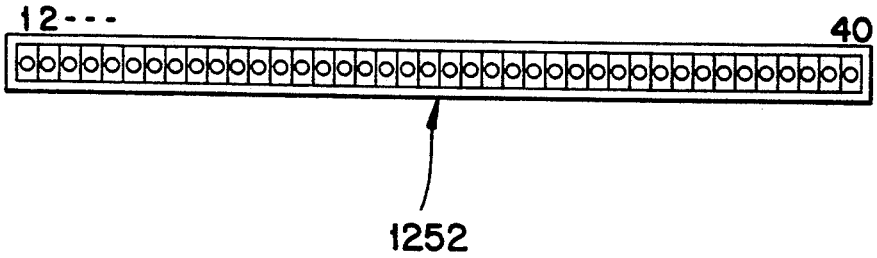
FIG. 4 is an elevation view of the LED array.

FIG. 3 shows the LED writing device, wherein item 1251 is the LED writing head, and item 1252 is the LED array. In the present embodiment, forty individual LEDs are arranged in a single row with a pitch of 1 mm, as shown in FIG. 4. The head 1251 is moved from left to right along the surface of the photosensitive drum 1 by means of a rope drive mechanism driven by a stepping motor 1253, as shown in the drawing. Sensors 1254 and 1255 are provided at both sides of the photosensitive drum 1 to detect the position of the head 1251, and are turned ON via an interrupter 1256 provided beneath the head.

Since the LED head 1251, which is smaller than the width of the photosensitive drum 1, is moved via the motor 1253 in the present embodiment, the head 1251 need not be moved when using the LED array to cover the width of the drum 1.

Figure 5:
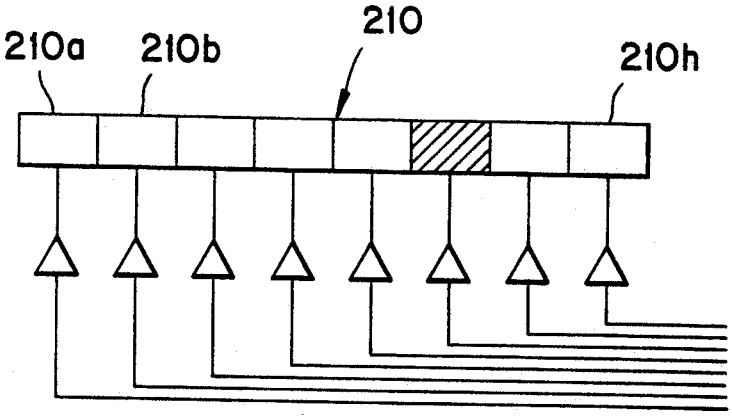
FIG. 5 is an illustration describing the liquid crystal shutter.

FIG. 5 shows the liquid crystal shutter 210. The liquid crystal comprises eight individual blocks (210*a* through 210*h*) which are independently controlled and arranged along the surface of the photosensitive drum 1 each 40 mm. The liquid crystal shutter 210 is turned ON when the driver is turned On by the signals transmitted from the first CPU 201 (FIG. 7), and the optical path can be shielded in 40 mm units corresponding to the length of the LED writing head 1251.

Figure 6:
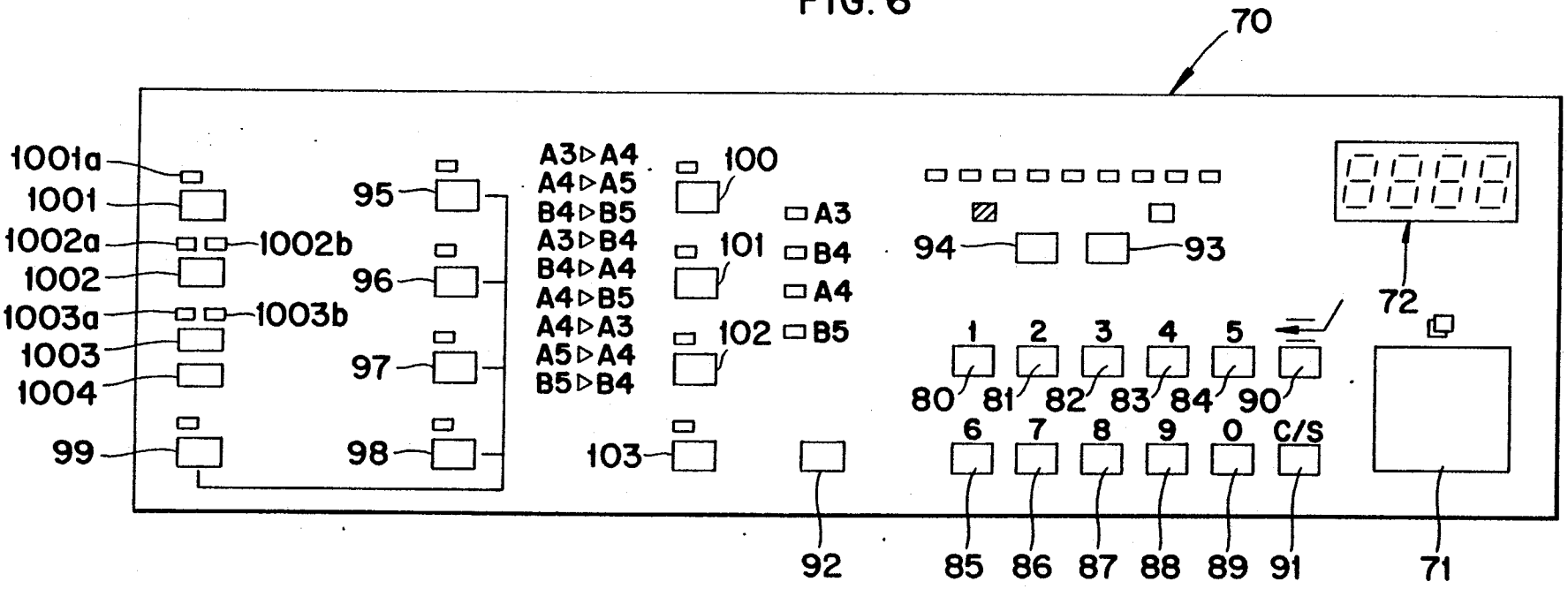
FIG. 6 is a top plan view of the operation panel of the copying apparatus.

FIG. 6 shows the arrangement of the various operation keys and display lights on the operation panel of the copying apparatus. Arranged on the operation panel 70 are print key 71, numeric display device 72 capable of displaying 4-digit numeric values, ten-key pad keys 80 through 89, interrupt key 90, clear/stop key 91, paper selection key 92, up and down keys 92 and 94 for setting the copy image density, and magnification keys 95 through 103 for setting the copy magnification.

The selection key 1001 switches between the normal copy mode for copying a single original document on a single copy sheet and the two-in-one mode. When the two-in-one mode is selected via the aforesaid selection key 1001, the display 1001*a* is lighted. The selection key 1002 selects either the copy mode for writing the date vertically, or the copy mode for writing the date horizontally. When the vertical date copying mode is selected the display light 1002*a* is lighted, and when the horizontal date copying mode is selected the display light 1002*b* is lighted. On the other hand, the selection key 1003 selects either the copy mode for writing the page numbers vertically, or the copy mode for writing the page numbers horizontally. When the vertical page number copy mode is selected the display light 1003*a* is lighted, and when the horizontal page number copy mode is selected the display light 1003*b* is lighted. The key 1004 is for inputting the copy page number.

Figure 7:
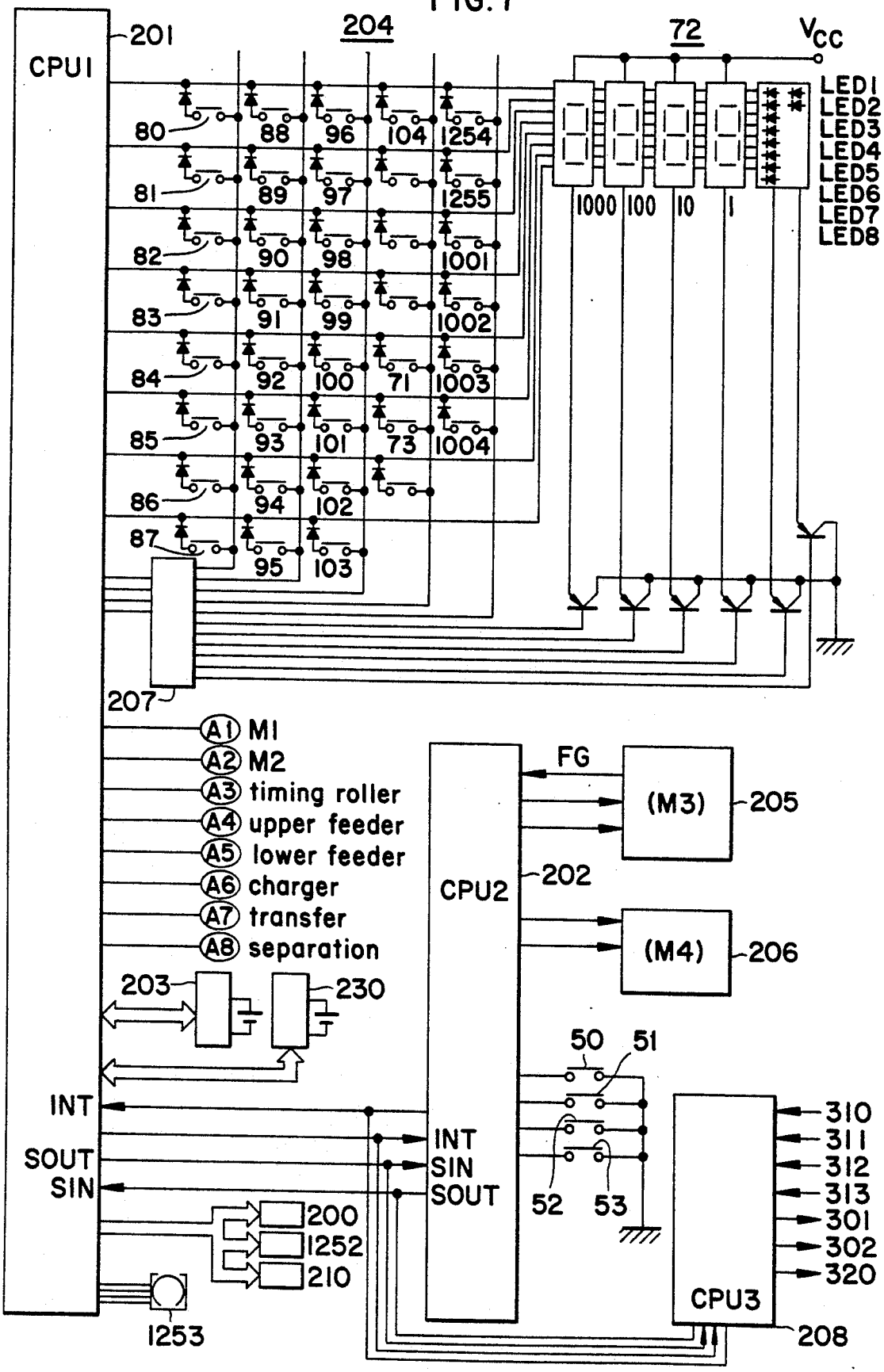
FIG. 7 is a diagram of the copying apparatus control circuit.

FIG. 7 shows the control circuit of the copying apparatus. The first microcomputer (first CPU) 201 controls the second CPU 202 for controlling the optical system 10 as well as the third CPU 208 for controlling the automatic document feeder (ADF) via the interrupt terminal INT and data input terminals SIN and SOUT.

The CPU 201 is connected to the RAM 203 which has a battery back-up, switch matrix 204, and decoder 207. The output terminals A1 through A8 are respectively connected to various drive switching transistors (not illustrated) for the main motor M1, developing motor M2, timing roller clutch CL1, upper feed clutch CL2, lower feed clutch CL3, charger 5, transfer charger 7, separation charger 8.

The first CPU 201 is connected to the inter-image eraser 200, LED array 1252, and liquid crystal shutter 210, as well as the stepping motor 1253. The second CPU 202 is connected to the DC (direct current) motor M3 drive circuit 205 used for original document scanning, stepping motor drive circuit 206 used for magnification, and switches 50 through 53. The switches 50 through 53 are reed switches. The various data for controlling the copying operation are written to the RAM 203. The integrated circuit (IC) 230 is used for copying the data which is battery backed-up as previously described.

Figure 8:
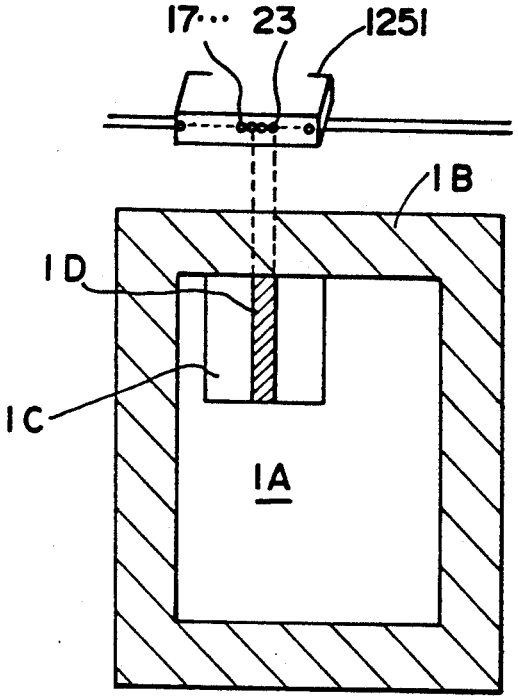
FIG. 8 is an illustration showing the relationship between the LED head and the latent image on the photosensitive drum.

FIG. 8 shows the relationship between the LED head 1251 and the electrostatic latent image formed on the surface of the photosensitive drum 1. In the drawing, the LED head 1251 is moved to the data writing position via the pulse motor 1253. The labeled item IA is the original document area, IB is the area other than the original document that is side-erased using the inter-image eraser 200, IB is the data writing area formed via the liquid crystal shutter 210, and ID is the actual data writing area formed via the LED head 1251 (written vertically in the present embodiment). In the illustrated example, the data are written using seven individual LEDs numbered 17~23 of the LED array 1252, whereas the LEDs numbered 1~16 and 24~40 are used for erasure. In this case, for example, the liquid crystal shutter 210 shields a 40 mm portion via the block 210*b* (refer to FIG. 5).

Figure 9:
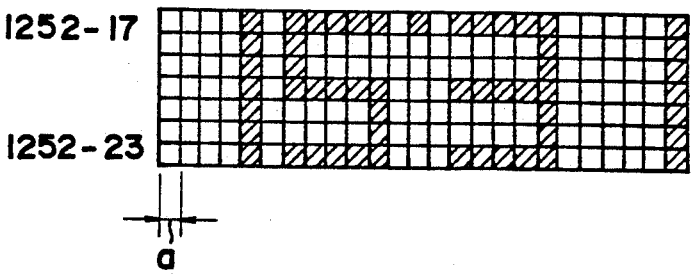
FIG. 9 shows an example of a copy data dot matrix.

Each LED of the LED array 1252 is controlled so that the ON time and OFF time of said LEDs result in a pitch of 1 mm in the advancing direction of the photosensitive drum 1 via the rotational speed of said drum, as shown in FIG. 9.

Figure 10:
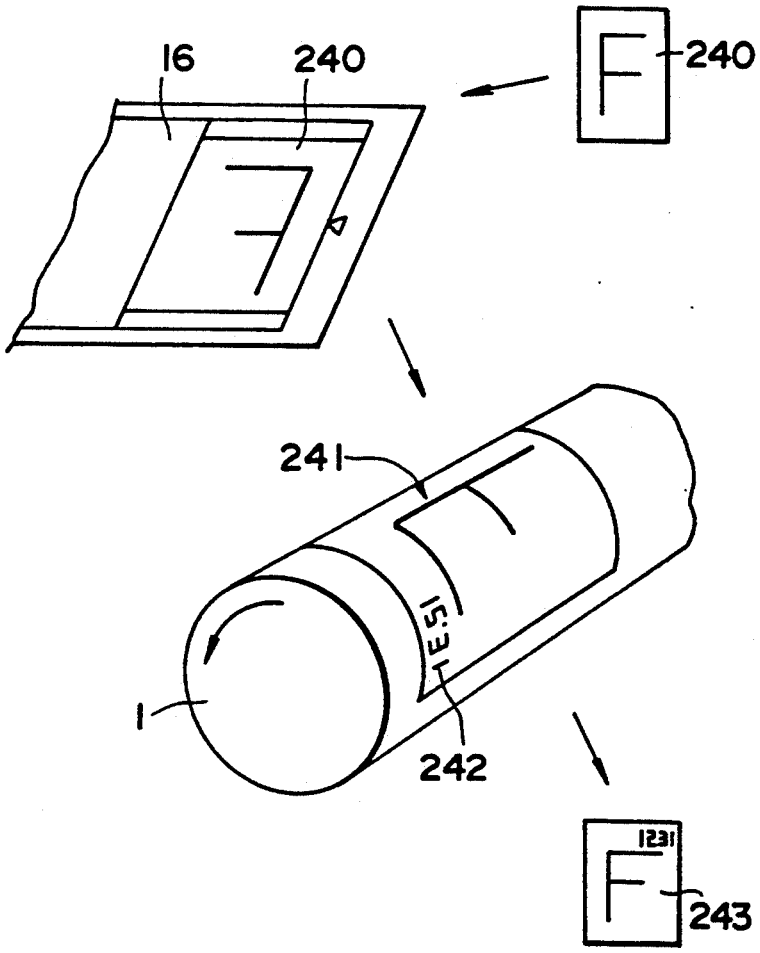
FIG. 10 shows the various stages of the example from the original document to end of a normal copying process.

FIG. 10 shows one example of the various stages from the original document until the end of the copying process. The A4 size original document 240 with the letter "F" written thereon is disposed on the glass document platen 16 so as to be transported horizontally (perpendicular to the transport direction in the lengthwise direction of the original). When the copy operation starts, the electrostatic latent images 241 and 242 of the original document and the additional data (date: 12·31) are formed on the surface of the photosensitive drum 1, and said latent images 241 and 242 are then transferred onto the copy sheet. The latent image 242 is formed to the upper right of the latent image 241.

FIG. 9 shows an example of the dot matrix wherein the additional data is the date of December 31st ([12·31] is written horizontally, i.e., in the original transport direction)- Seven individual light-emitting diodes, i.e., the LED Nos. 17~23, of the LED array 1252 are lighted and extinguished in a predetermined sequence in accordance with the rotation of the photosensitive drum 1. In the case of the aforesaid date data [12·31], all the light-emitting diodes Nos. 17·23 are first lighted, the photosensitive drum 1 is rotated only through a first angle of rotation, all light-emitting diodes Nos. 17~23 are extinguished and [1] is copied. Then, the photosensitive drum 1 is rotated only through a second angle of rotation and only the light-emitting diodes Nos. 21 and 22 are lighted, the drum is rotated only through a third angle of rotation and only the light-emitting diodes Nos. 18, 19, 21 and 22 are lighted through a fourth angle of rotation, then only the light-emitting diodes Nos. 18 and 19 are extinguished through the third angle of rotation and [2] is copied. Thereafter, [3] and [1] are copied in the same manner. Page numbers are also copied using the same method.

Figure 11:
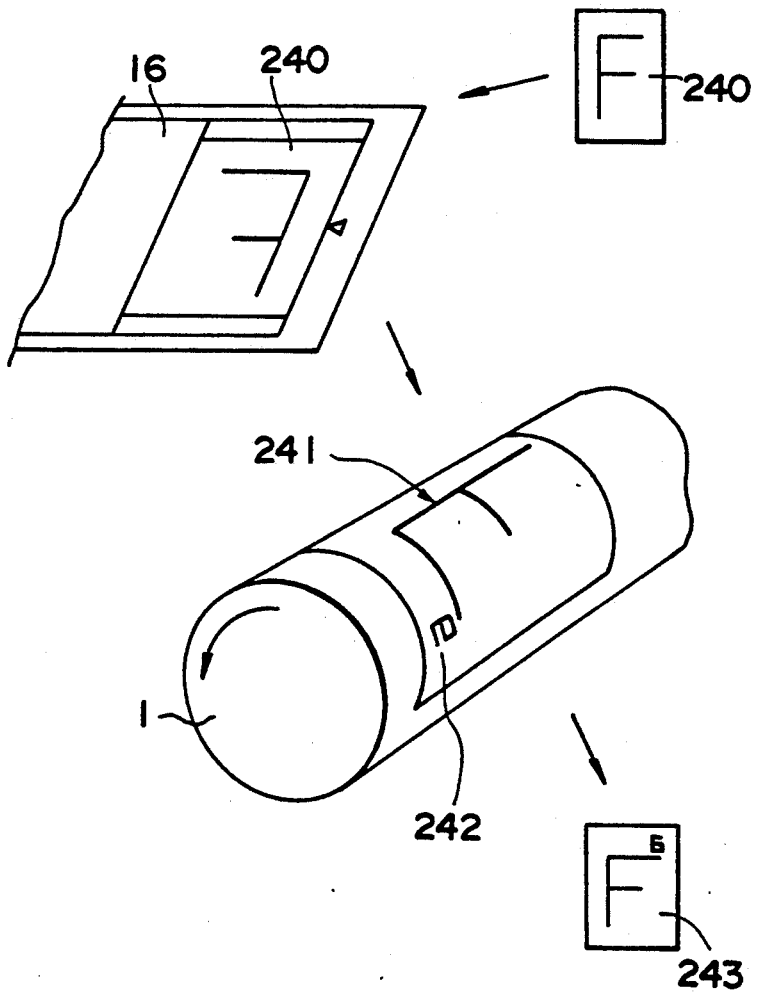
FIG. 11 shows the various stages of another example from the original document to end of a normal copying process.

FIG. 11 shows an example wherein an A4 size original document 240 with the letter "F" written thereon is copied, and the page number [6] is copied in the same manner as the aforesaid example in which the date was copied.

The aforesaid copying apparatus has a two-in-one copy mode function wherein two original documents are copied side by side onto a single copy sheet surface using an automatic document feeder ADF (described later). In the two-in-one mode, the date and page number data can be copied to positions corresponding to each of the original documents on the copy sheet. The controls for the aforesaid two-in-one mode additional data copying are discussed later in details, but are shown in FIGS. 12 and 13 which show examples of the various stages from the original document to the end of the copying process when the date [12·31] and page numbers [5] and [6] are copied.

Figure 12:
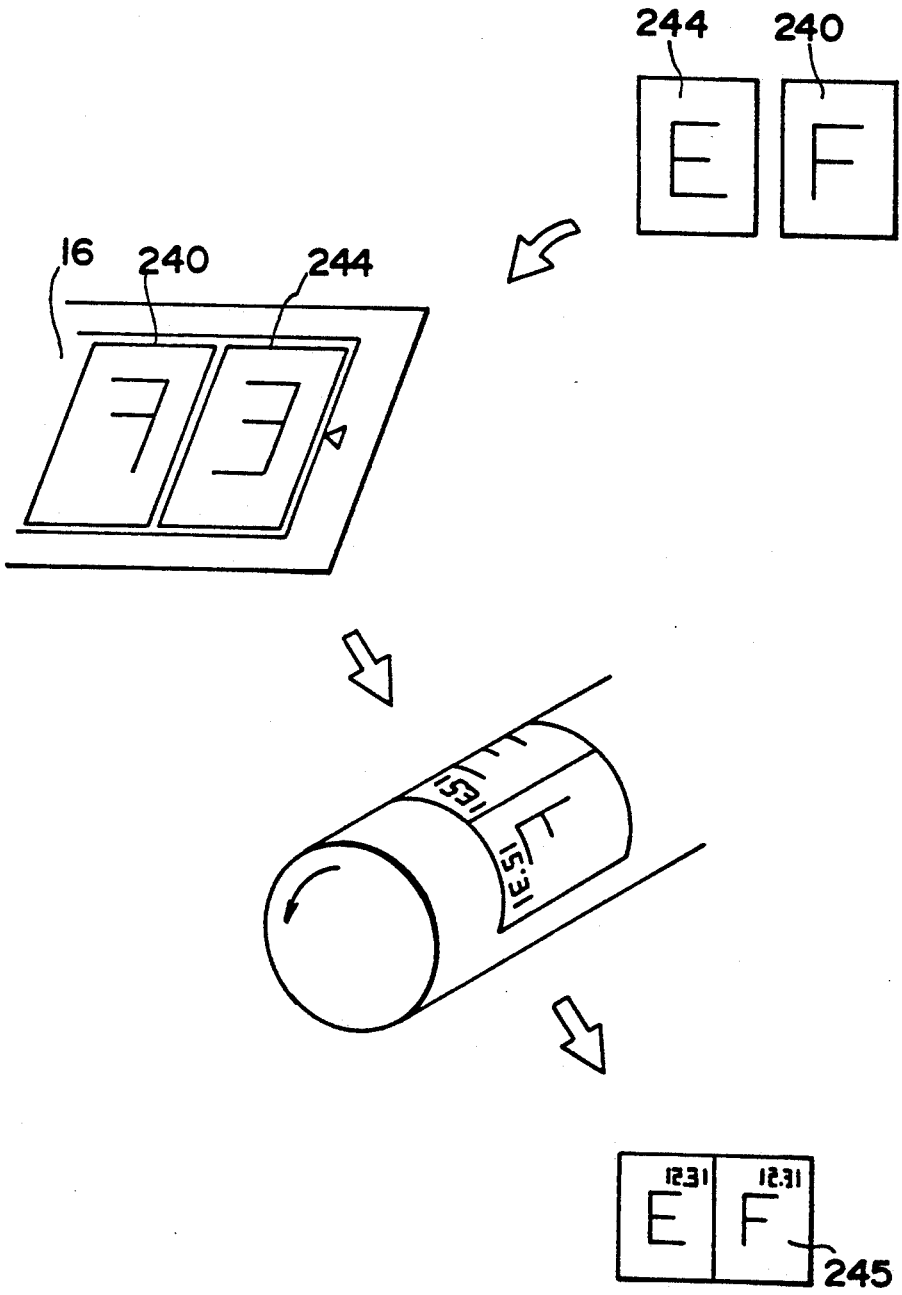
FIG. 12 shows the various stages of an example from the original document to the end of the two-in-one copy process.

FIG. 12 shows an example wherein two A4 size original document 244 and 240 with the letters "E" and "F" respectively written thereon are fed horizontally onto the document platen 16 so as to be placed side by side. Both the aforesaid original documents are copied onto a single surface of the A4 size copy sheet 245 at a magnification of 0,707, and date data are copied at positions corresponding to each original document.

Figure 13:
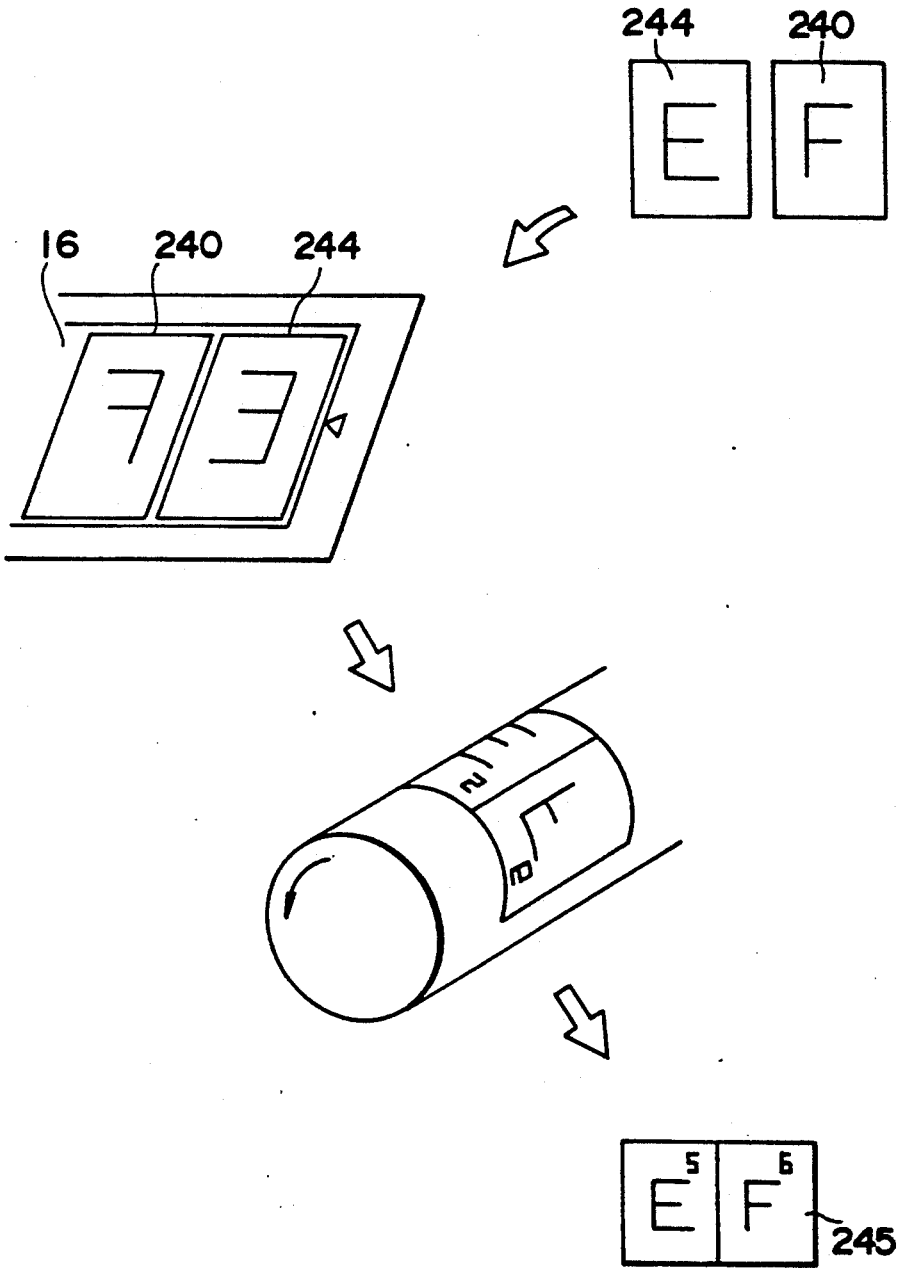
FIG. 13 shows the various stages of another example from the original document to the end of the two-in-one copy process.

FIG. 13 similarly shows an example wherein the consecutive page numbers [5] and [6] are copied to positions corresponding to each original document.

The date and magnification copy data are respectively stored in the RAM 203 and the clock IC 230 both of which have battery back-up, and can be displayed on the numeric display device 72 on the operation panel via the first CPU 201. The page numbers are set by a method described later.

The data copying position can be changed depending on the size of the copy sheet and whether or not the normal copy mode or the two-in-one copy mode is selected. That is, the time required to move the LED head 1251 from the state wherein the interrupter 1256 is detected by the sensor 1255 to the position corresponding to the data copying position in a direction perpendicular to the direction of rotation of the latent images is stored in the RAM 203 in accordance with the size of the copy sheet. Furthermore, in order to control the data copying position in the direction of rotation of the latent image, the value of the timer M1 used in the normal copy mode and the values of the timers N1 and N2 used in the two-in-one copy mode are respectively stored multiply in the RAM 203 in accordance with the various sizes of the copy sheets. The operating timing for opening and closing the liquid crystal shutter 210 must be changed in conjunction with changes of the data copying position. Timers are also provided to control the operating timing of the liquid crystal shutter 210; the values of the timers L1 and L2 for the normal copy mode, and timers K1 through K4 for the two-in-one copy mode are respectively stored in the RAM 203 in accordance with the various sizes of the copy sheets.

Figure 14:
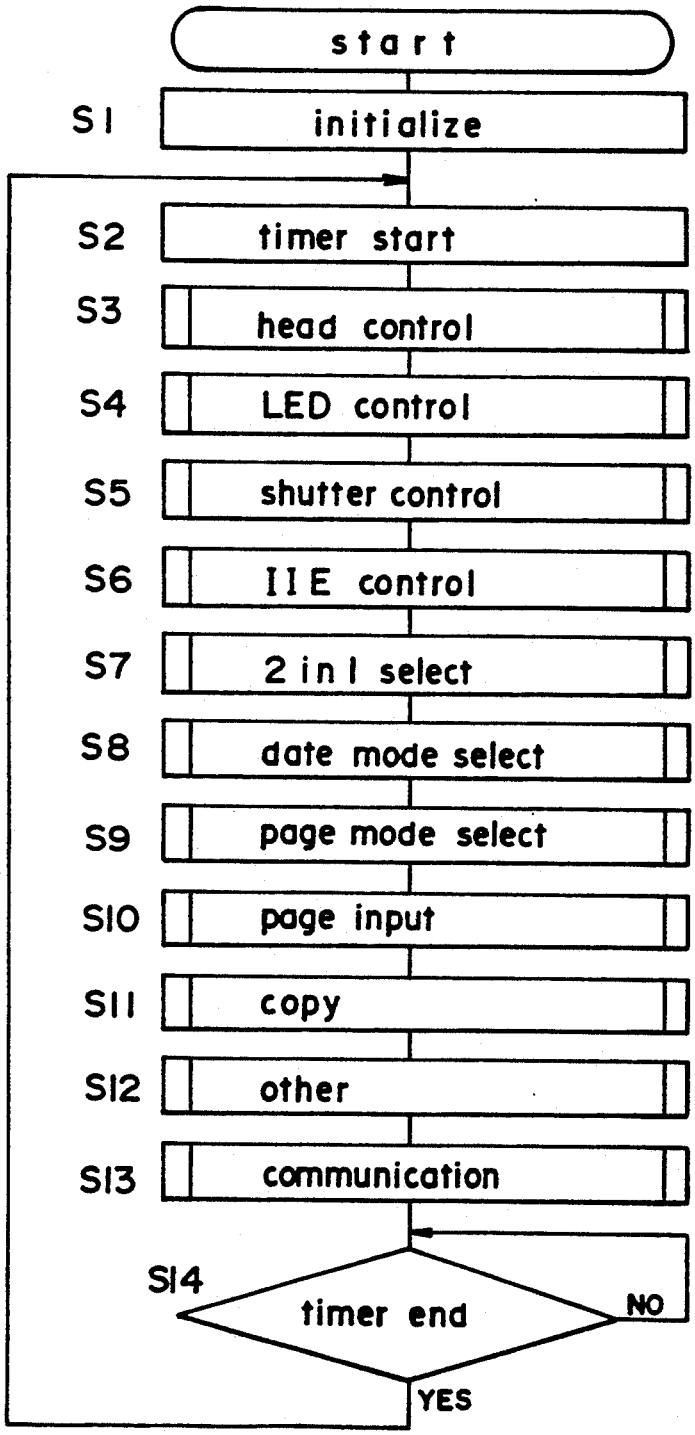
FIG. 14 is a flow chart showing the essential operation of a first CPU for controlling the copying apparatus.

FIG. 14 shows a flow chart of the operation of the first CPU 201 for controlling the copying apparatus. When the first CPU 201 is reset, the program is started to execute initialization for clearing the RAM 203, initialize the settings and the like of the various registers of the first CPU, and set the initialization mode of the devices (step S1).

Then, the internal timers of the first CPU are started, the values of said internal timers having been previously set at initialization (step S2).

The various subroutines shown in the flow chart are then called in the sequence described below (step S3 through S13).

The head control routine (step S3) controls the position of the LED head 1251. The LED array control routine (step S4) controls the lighting of the LED array 1252. The liquid crystal shutter control routine (step S5) controls the operation of the liquid crystal shutter 210. The inter-image eraser (IIE) control routine (step S6) controls the inter-image eraser 200. The two-in-one mode select routine (step S7) controls two-in-one copying, the date mode select routine (steps S8) sets date data writing mode, the page mode select routine (step S9) sets the page data writing mode, the page input routine (step S10) executes the writing of the page number. The copy operation routine (step S11) executes the copying process.

After the aforementioned subroutines have been called, the first CPU executes other processes (step S12) and communicates with the other CPUs (step S13). Thereafter, the end of the internal timer set at initialization is awaited (step S14), whereupon a single routine is completed.

Figure 15:
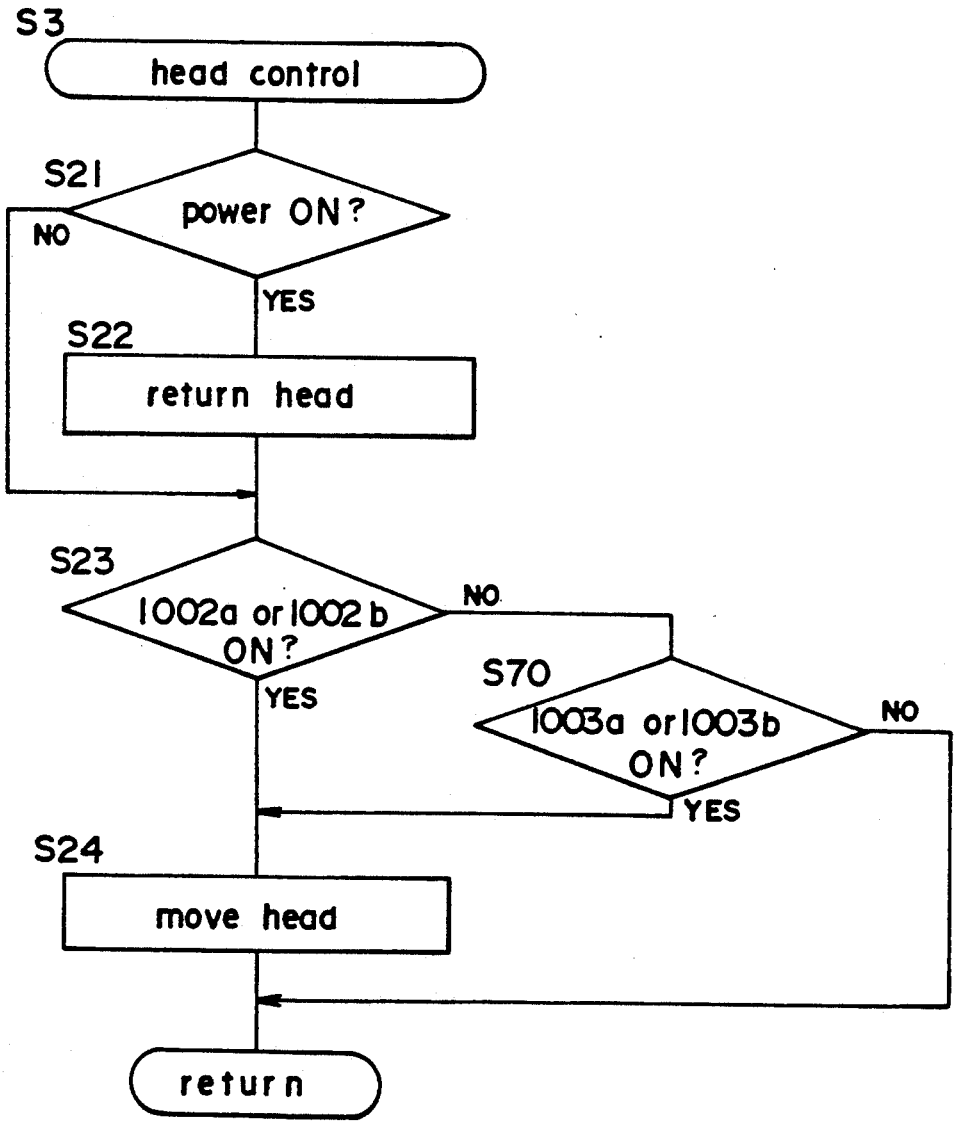
FIG. 15 is a flow chart showing the head control routine.

FIG. 15 shows the head control routine (step S3). When the power is turned ON (step S21), first, the motor 1253 is rotated until the switch 1254 (refer to FIG. 4) is turned ON via the interrupter 1256 to return the LED head 1251 to the set position (step S22). Then, when the date mode or the page mode is selected (steps S23, S70), the head 1251 is moved to the data writing position in step S24.

If neither the date mode nor page mode is selected, the program returns directly to the main routine.

Figure 16:
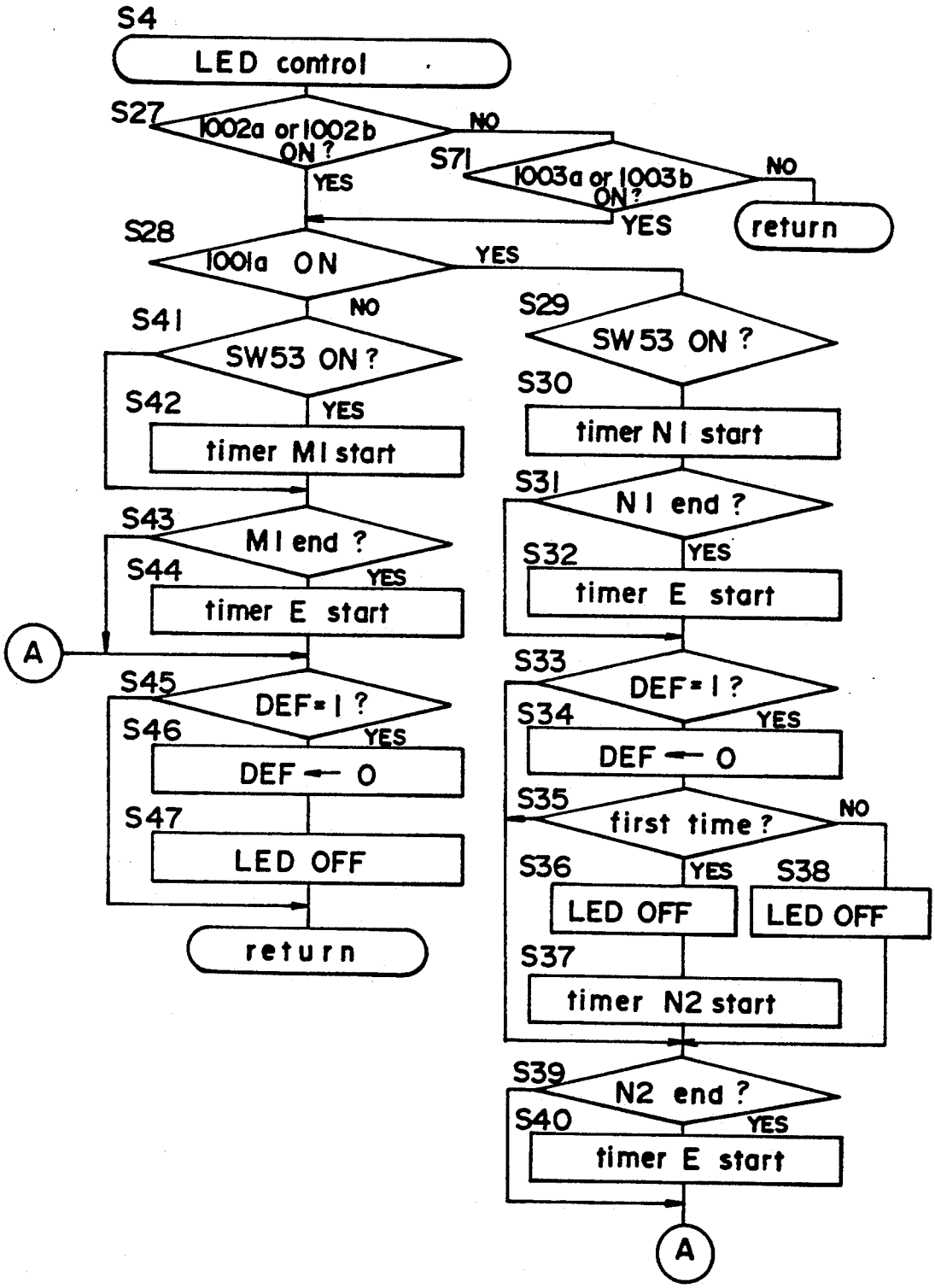
FIG. 16 is a flow chart showing the LED array control routine.

FIG. 16 shows the LED array control routine (step S4). If, in step S27, the date mode display 1002*a* or 1002*b* is ON, and in step S28 the two-in-one mode display 1001*a* is turned ON, the process of steps S29 through S40 are executed, then the program returns to the main routine, whereas if, in step S28, the two-in-one display 1001*a* is OFF, the process of steps S41 through S47 are executed, then the program returns to the main routine. The process is similarly executed when the page mode display 1003*a* or 1003*b* is ON in step S71, whereas if, in step S71, the display 1003*a* is OFF, the program directly returns to the main routine.

The process of steps S29 through S40 of the two-in--one mode changes the timer values so as to executed twice the process of steps S41 through S44 of the normal copy mode.

When the scanner of the optical system 10 turns ON the image leading edge switch SW53 (step S29), the timer N1 is started (step S30).

Figure 17:
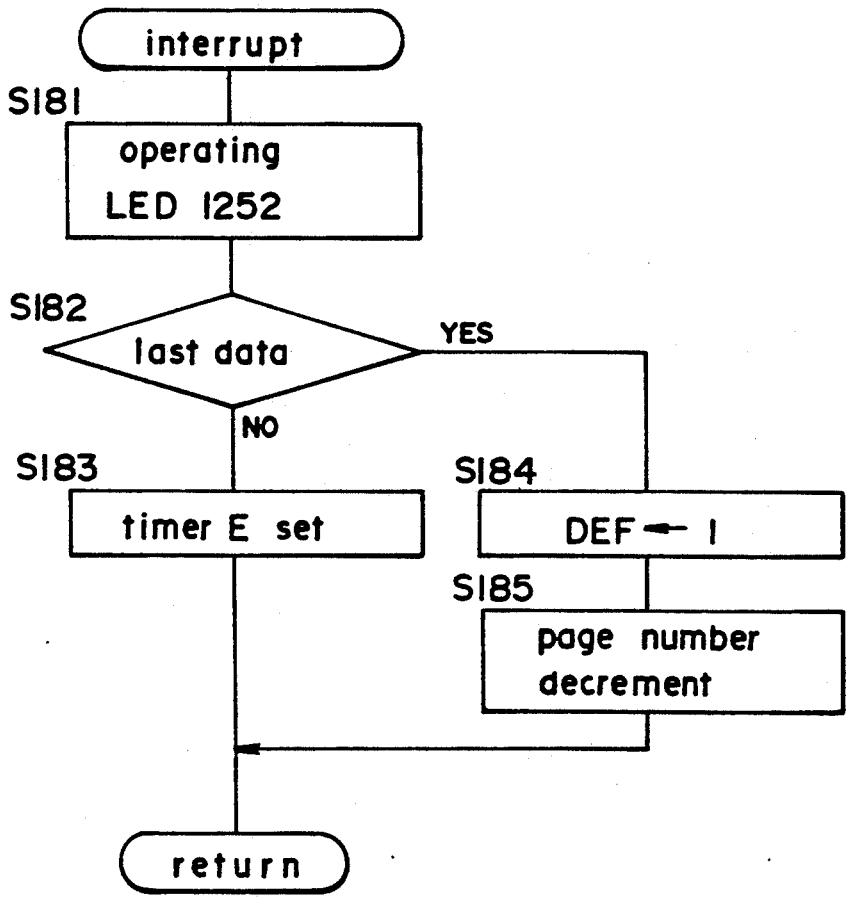
FIG. 17 is a flow chart showing the internal timer interrupt.

When the timer N1 ends (step S31), the timer E is started (step S32). A timer interrupt is executed when the timer E ends, as shown in FIG. 17, and data copying starts. The value of the timer E is the time period for lighting each LED of the LED head for a single data segment. In the present embodiment, the width of a single LED is 1 mm, so that the LED lighting time is the period for covering 1 mm on the surface of the drum, i.e., 1 mm/drum speed becomes the value of the timer E. Thus, when a single LED of the LED array designated as a single lighting unit, only a squareshaped pattern 1×1 mm in area is erased.

The timer interrupt routine (FIG. 17) sets the data end flag DEF, which indicates the end of data copying, at [1] (step S33), and said flag DEF is set at [0] when a 40 mm data segment has been written (step S34). After the end of the first time data writing (step S33, YES), all LEDs are extinguished (step S36) and the timer N2 is started (step S37). When the timer N2 ends (step S39), the timer E is started (step S40), and the timer interrupt is executed again at the moment the timer E ends, as shown in FIG. 17, and the data copying starts. When the data end flag DEF is set at [1] via the timer interrupt shown in FIG. 17 (step S45), said flag DEF is reset at [0] in step S46, and all LEDs are extinguished in step S47.

On the other hand, in the normal copy mode (step S28, NO), the timer M1 is started when the image leading edge switch SW is turned ON (steps S41, S42). When the timer M1 ends, the timer E is started (steps S43, S44), and the data copying is executed via the aforementioned timer interrupt at the moment the timer E ends. Then, when the data copying is completed and the data end flag DEF has been set at [1], said flag is set at [0] and all LEDs are extinguished (steps S45, S46, S47).

FIG. 17 shows the internal interrupt routine executed when the timer E ends. When the time of timer E is completed, an internal interrupt is executed, and the individual LEDs Nos. 1 through 40 of the LED array 1252 are controlled in accordance with the data. That is, light-emitting diodes Nos. 1~40 of the LED array 1252 are lighted in accordance with the copy data (step S181). The copy data are generated based on the date stored in the IC 230 when the date mode is selected, or based on the page numbers stored in the RAM 203 when the page mode is selected. At this time, if the copy data are not the last data (step S182), the timer E set (step S183), whereas if the copy data are the last data, the data end flag DEF is set at [1], and the page number data stored in the RAM 203 are decremented (steps S184, S185). When the internal timer E is not set, this interrupt is not executed, so that when the data end flag DEF becomes [1], the interrupt process ends.

Figure 18:
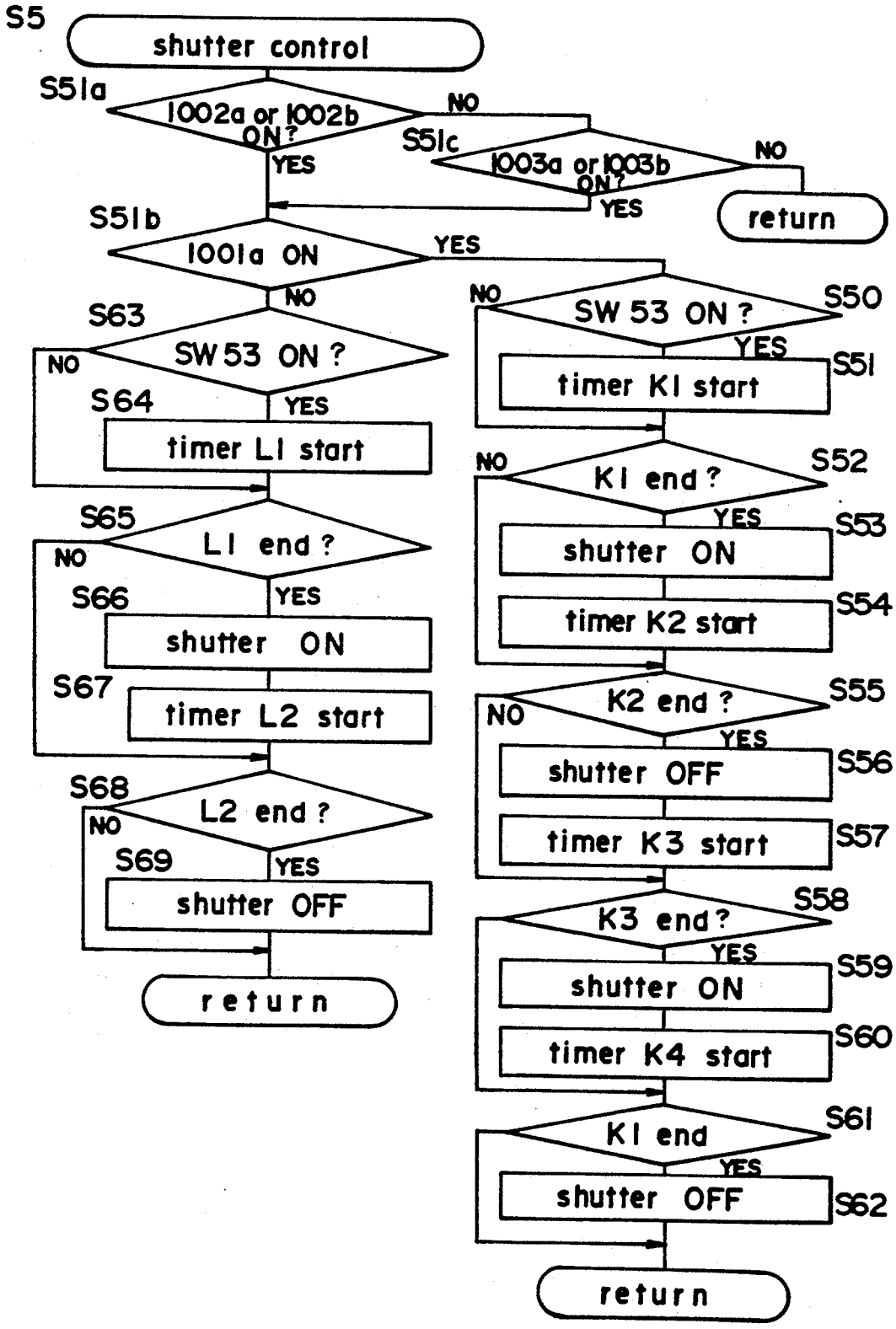
FIG. 18 is a flow chart showing the liquid crystal shutter control routine.

FIG. 18 shows the liquid crystal shutter control routine (step S5). If the date mode select display 1002*a* or 1002*b* is lighted in step S51*a* and the two-in-one mode select display 1001*a* is ON is in step S51*b*, the process of steps S50 through S62 is executed and the program returns to the main routine. If the two-in-one mode display 1001*a* is OFF in step S51*b*, the process of steps S63 through S69 is executed and the program returns to the main routine. When the page mode display 1003*a* or 1003*b* is ON in step S51*c*, the process is the same. When the display 1003*a* is OFF in step S51*c*, the program immediately returns to the main routine.

The processes of steps S50 through S60 of the two-in-one mode, change the values of the timers so as to execute twice the process of steps S63 through S69 of the normal copy mode. Details of the steps S63 through S69 are described hereinafter.

The timer L1 turns OFF the liquid crystal shutter 210 so as to open the optical path from the image leading edge to a predetermined data writing position. The timer L2 controls the time during which the liquid crystal shutter 210 remains turned ON. The timing for turning ON the shutter 210 is after the image leading edge switch SW53 is turned ON (step S63) to the end of the timer L1 at the width direction coordinate position (steps S64, S65), whereupon the shutter is turned ON (step S66). Concrete examples of the timer values can be determined by the expression:

$$40\ \text{mm} \div \text{scan speed} \times (W-1)$$

where W is the number of the liquid crystal segments 210*a* through 210*h*. That is, if the coordinate is 1, then $W-1=0$, such that the image leading edge switch SW53 is turned ON and the liquid crystal segment 210*a* is turned ON. Once the segment is turned ON, the timer L2 is started (step S67), the 40 mm segment (40 mm÷scan speed) period elapses (step S68), and the liquid crystal segment 210*a* is turned OFF (step S69).

In the process of steps S50 through S62, data are written in two locations corresponding to each original document on a single copy sheet so that the timers K1 and K2 are used instead of the timer L1, and the timers K3 and K4 are used instead of the timer L2 in the steps S63 through S69.

Figure 19:
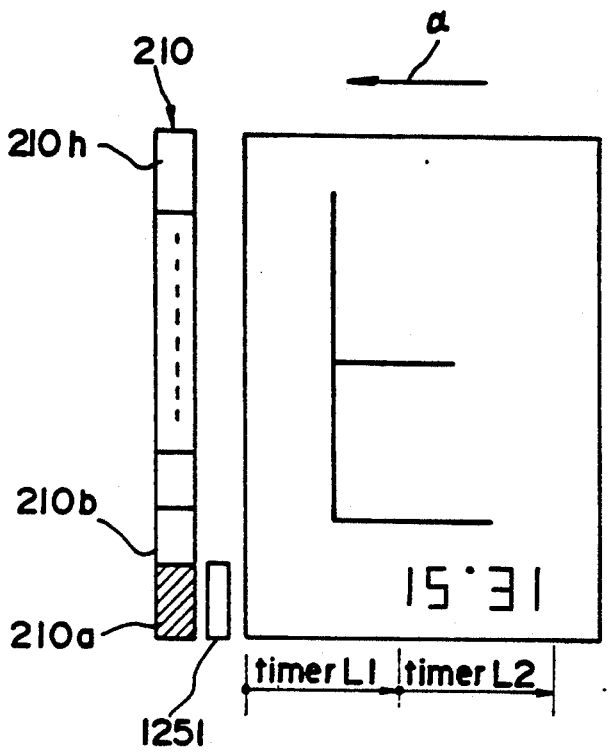
FIG. 19 is an illustration of the date data writing operation in the normal copy process, corresponding to FIG. 10.
Figure 20:
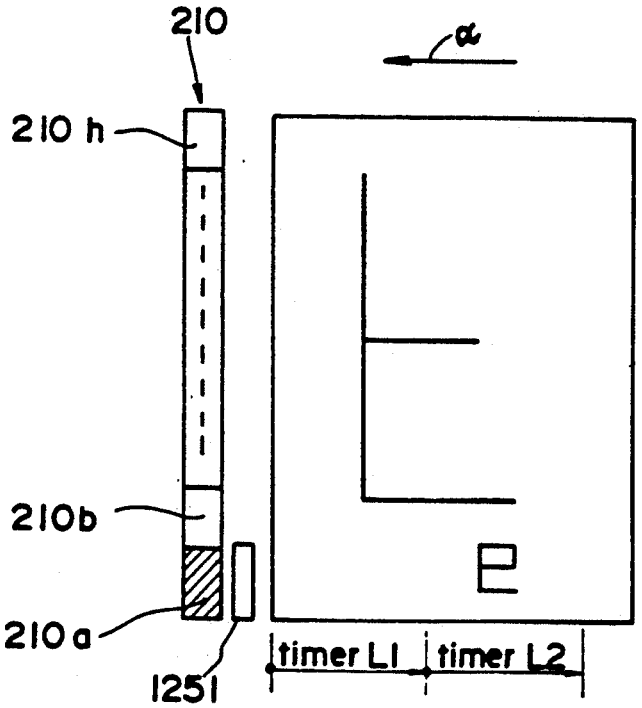
FIG. 20 is an illustration of the page number writing operation in the normal copy process, corresponding to FIG. 11.

Using the examples of date copying and page number copying of the normal copying process shown in the previously described FIGS. 10 and 11, the positional relationships of the block 210*a* of the shutter 210 used for copying, the LED head 1251, and the electrostatic latent image formed on the surface of the photosensitive drum 1, and the operation ranges of the aforesaid timers L1 and L2 are shown in FIGS. 19 and 20. The arrow $\alpha$ in the drawings indicate the direction of advance of the surface of photosensitive drum 1.

Figure 21:
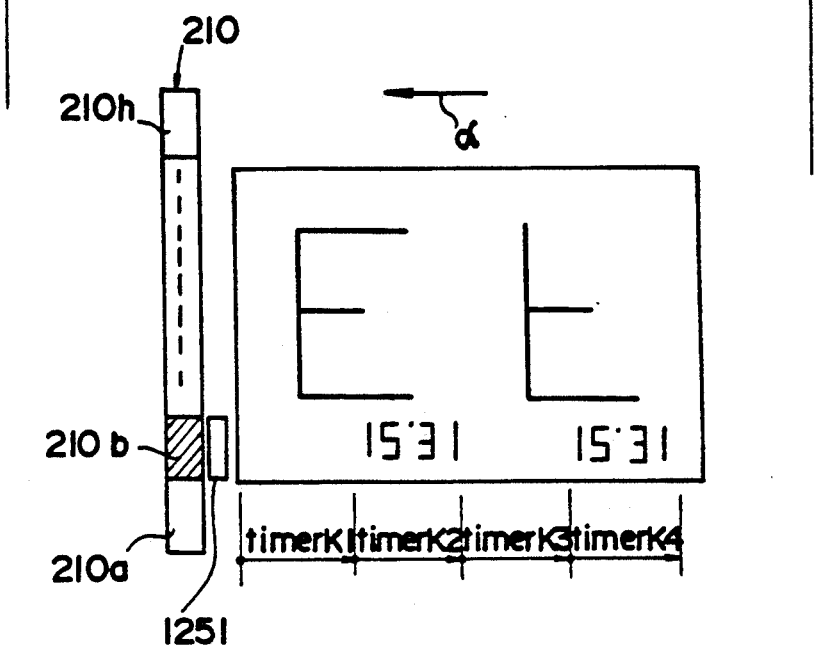
FIG. 21 is an illustration of the date data writing operation in the two-in-one copy process, corresponding to FIG. 12.
Figure 22:
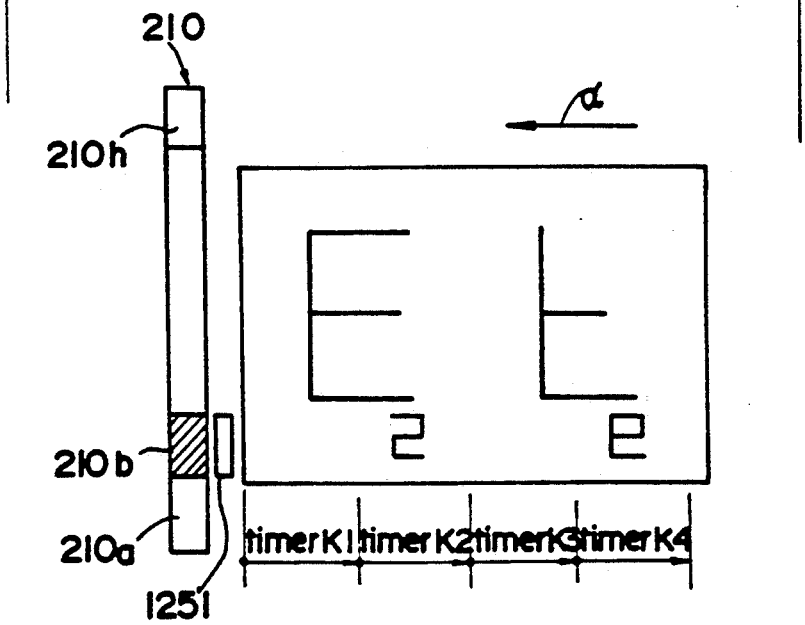
FIG. 22 is an illustration of the page number writing operation in the two-in-one copy process, corresponding to FIG. 13.

Using the examples of date copying and page number copying of the two-in-one copy mode in the previously described FIGS. 12 and 13, the positional relationships of the block 210*b* of the shutter 210 used for copying, the LED head 1251, and the electrostatic latent image formed on the surface of the photosensitive drum 1, and the operation ranges of the aforesaid timers K1, K2, K3 and K4 are shown in FIGS. 21 and 22. The arrow $\alpha$ in the drawings indicate the direction of advance of the surface of photosensitive drum 1.

Figure 23:
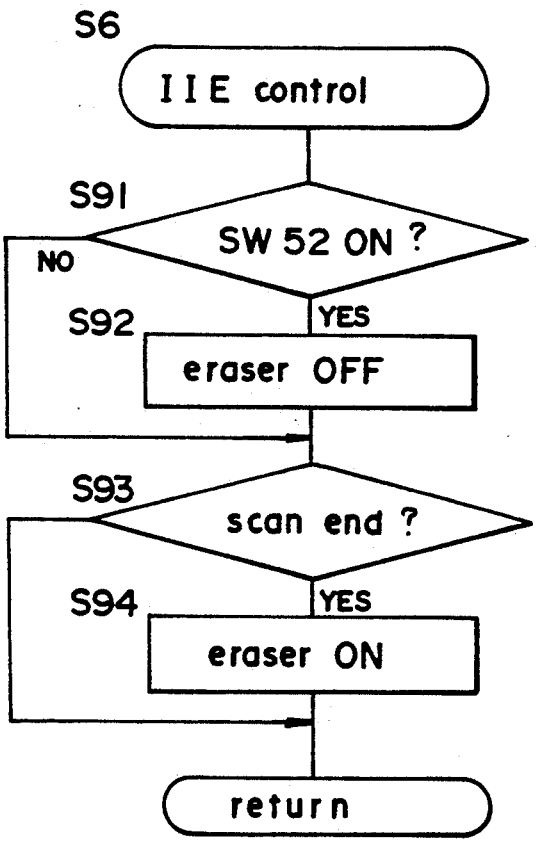
FIG. 23 is a flow chart of the inter-image eraser control routine.

FIG. 23 shows the inter-image eraser (IIE) 200 control routine (step S6). When the scan of the optical system 10 turns ON the eraser switch SW52 (step S91), the IIE 200 is turned OFF (step S92), the scan ends (step S93), and the IIE is turned ON (step S94), i.e., the IIE 200 is turned OFF during the time the latent image is formed on the surface of the photosensitive drum 1.

Figure 24:
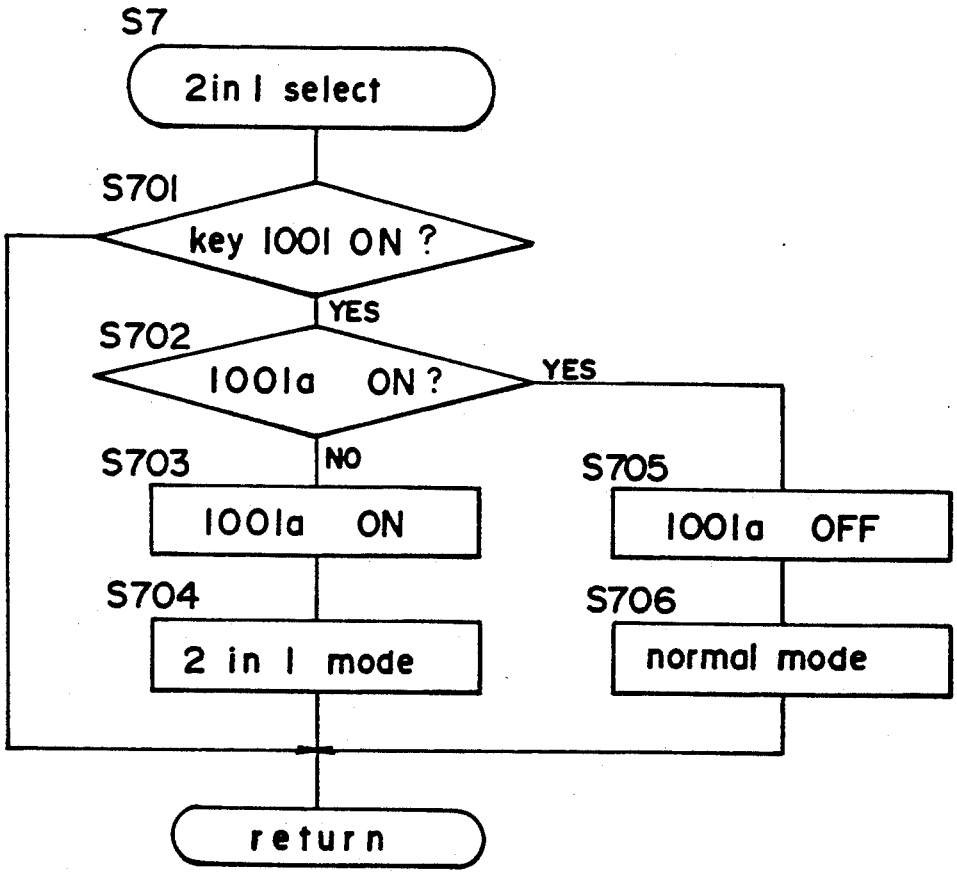
FIG. 24 is a flow chart of the two-in-one select routine.

FIG. 24 shows the two-in-one select routine (step S7). If the two-in-one mode display 1001*a* is OFF (step S702) when the two-in-one mode select key 1001 is turned ON (step S701), said display 1001*a* is turned ON (step S703) and the two-in-one mode selection is transmitted to the thirds CPU 208 (step S704). However, if the display 1001*a* is ON (step S702) when the aforesaid key 1001 is turned ON, said display 1001*a* is turned OFF (step S705) and the non-two-in-one mode (i.e., normal mode) selection is transmitted to the third CPU 208 (step S706).

Figure 25:
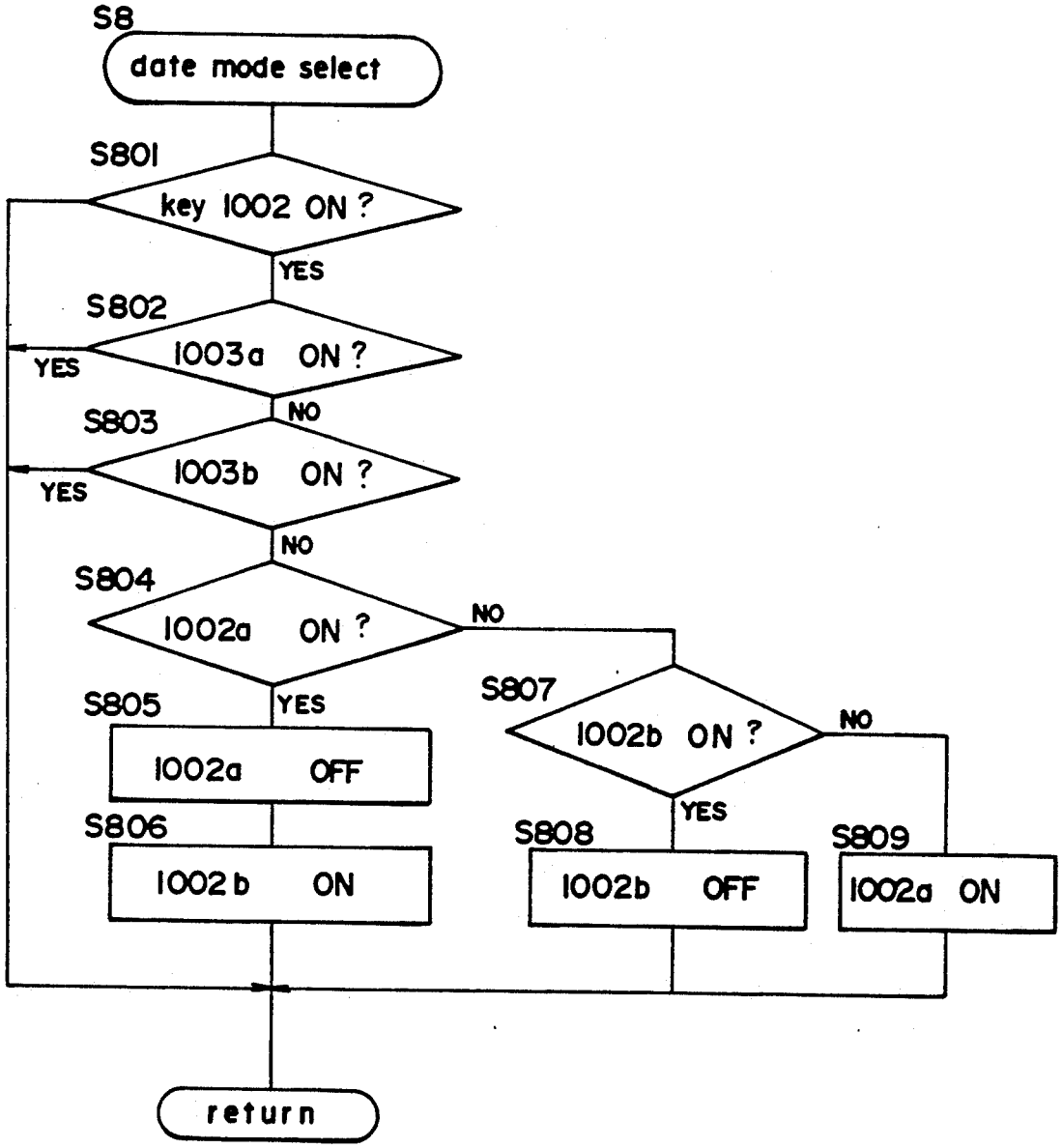
FIG. 25 is a flow chart of the date mode select routine.

FIG. 25 shows the date mode select routine (step S8). If the date mode select key 1002 is turned ON (step S801) when either of the page mode displays 1003*a* and 1003*b* are ON, the program returns to the main routine (steps S802, S803). However, when the aforesaid displays 1003*a* and 1003*b* are both OFF, a check is made to determine whether or not the vertical date mode display light 1002*a* is ON. When the display light 1002*a* is already ON, said display 1002*a* is turned OFF and the horizontal date mode display light 1002*b* is turned ON (steps S804 through S806). On the other hand, if the horizontal date mode display 1002*b* is found to be ON by the aforesaid check, said display 1002*b* is turned OFF, and when both displays 1002*a* and 1002*b* are found to be OFF, the display 1002*a* is turned ON (steps S807 through S809).

Figure 26:
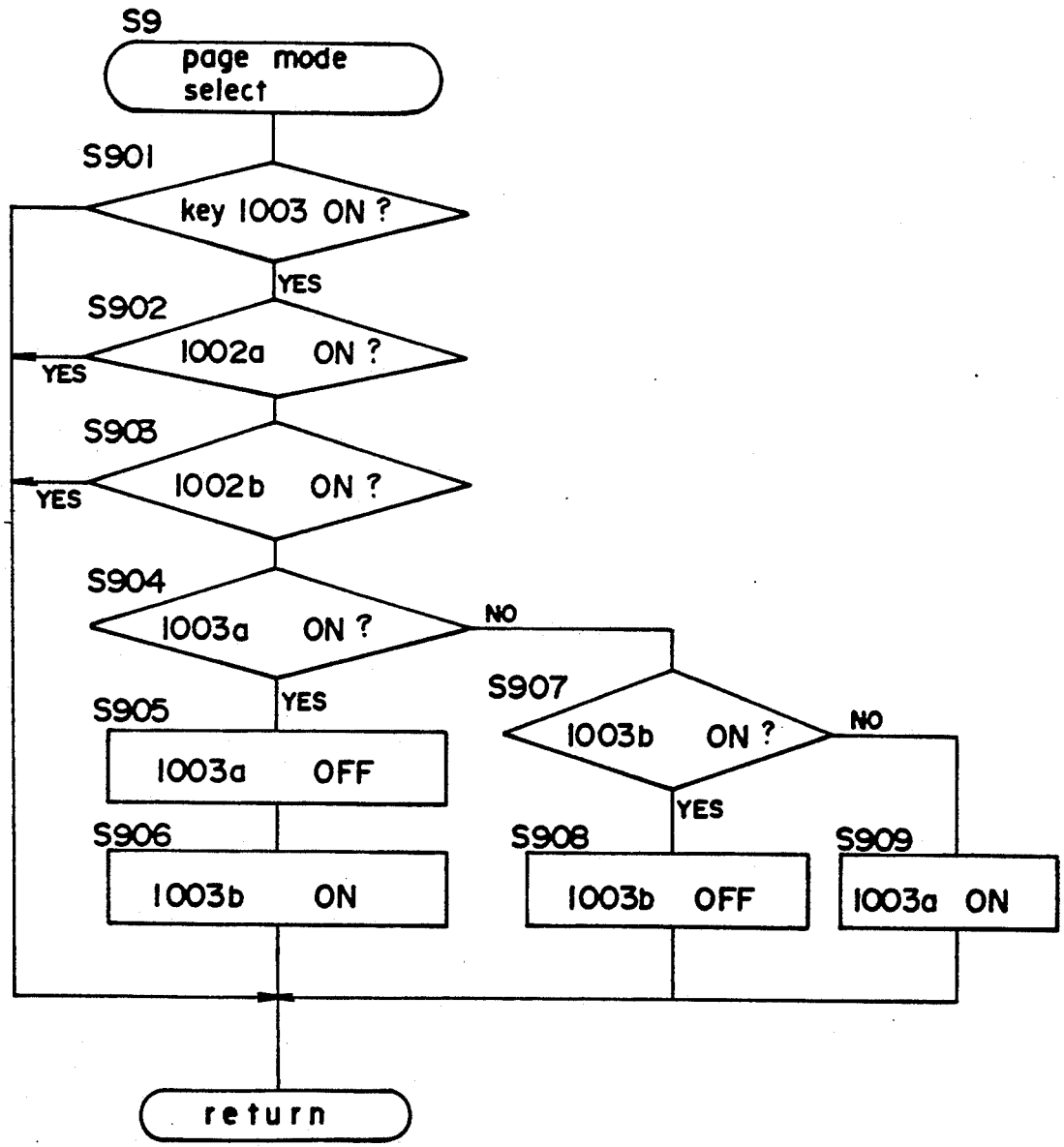
FIG. 26 is a flow chart of the page mode select routine.

FIG. 26 shows the page mode select routine (step S9). When the page mode select key 1003 is turned ON (step S901) and either of the date mode display lights 1002*a* and 1002*b* are ON, the program returns to the main routine (steps S902, S903). However, if both the display lights 1002*a* and 1002*b* are OFF, a check is made to determine whether or not the vertical page mode display light 1003*a* is ON. When the display 1003*a* is ON, said display light is turned OFF, and the horizontal page mode display light 1003*b* is turned ON (steps S904 through S906). On the other hand, if the display light 1003*b* is already ON, said display 1003*b* is turned OFF, and when both displays 1003*a* and 1003*b* are found to be OFF, the display 1003*a* is turned ON (steps S907 through S909).

Figure 27:
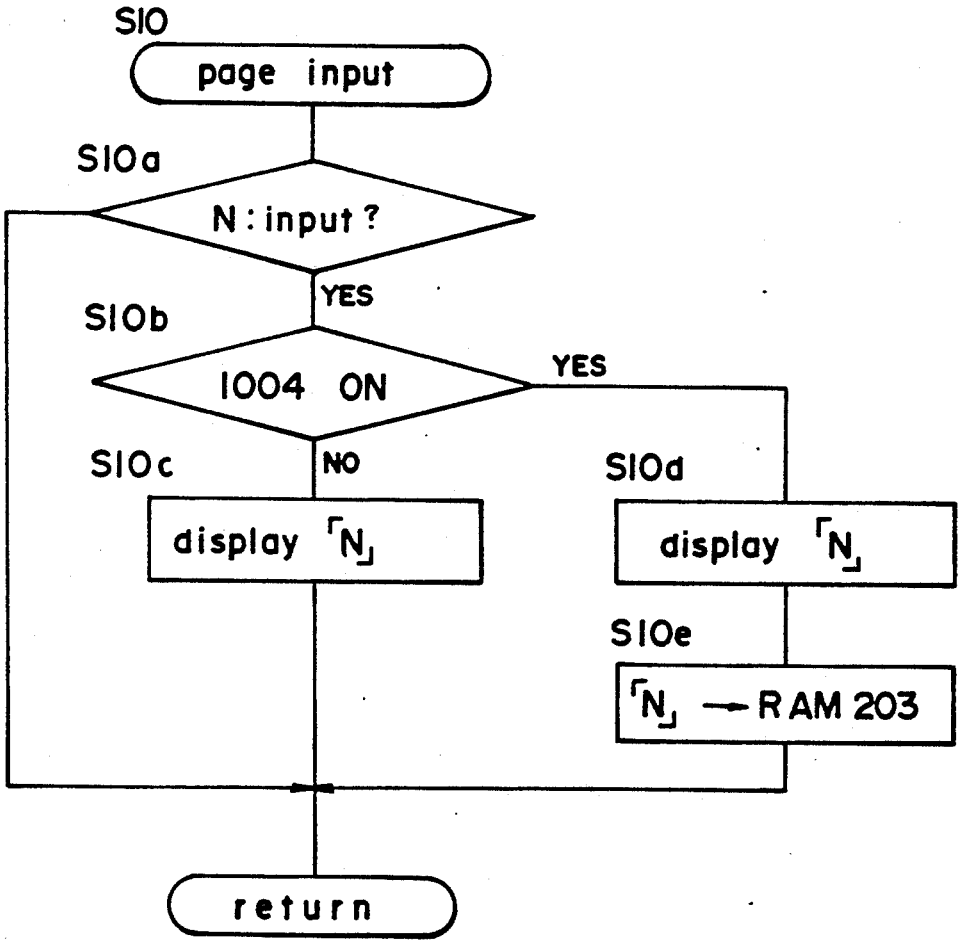
FIG. 27 is a flow chart of the page input routine.

FIG. 27 shows the page input routine (step S10). When the page number input key 1004 is ON (step S10*b*), the numeric value N input via the ten-key pad is displayed on display 72 of the operation panel as the total number of pages (step S10*d*), and said number N is stored in the RAM 203 (step S10*e*). When the key 1004 is OFF in step S10*b*, the numeric value N input via the ten-key pad is displayed on the display 72 as the number of copies (step S10*c*).

The copy routine shown in step S11 uses a well known electrophotographic method to copy the image of an original document placed on a glass document platen onto a copy sheet from a selected paper supply portion at a selected copy magnification. More specifically, the main motor M1, developing motor M2, charger 3, transfer charger 7, separation charger 8, feed roller clutches, scan motor M3, timing roller clutches and the like are all operated with predetermined timing. Details of the operating timing of each of the aforesaid elements are omitted from the present description since such operating timing is well known.

Furthermore, during the copy operation of step S11, the aforesaid LED array control routine of step S4 and the liquid crystal shutter control routine of step S5 are parallel executing processes. The page number and date data are written onto the copy sheet by the LED array and liquid crystal shutter via the aforesaid processes.

The third CPU 208 shown in FIG. 7 outputs control signals to the transport motor 310 and feed motor 302 to control the ADF, and receives the input signals transmitted from the feed sensor 310, original document sensor 311, original detecting sensor 312 and original output sensor 313.

Figure 28:
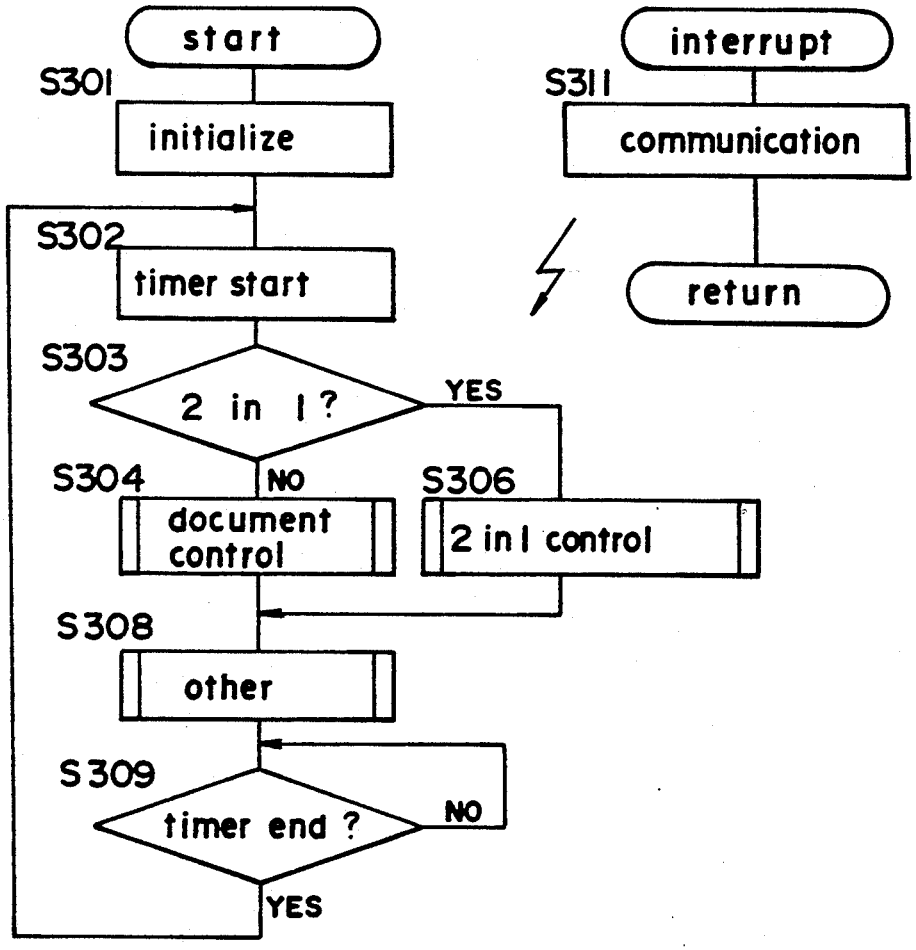
FIG. 28 is a flow chart showing the operation of the third CPU for controlling the automatic document feeder.

FIG. 28 is a flow chart showing the operation of the third CPU 208.

The initialization process is executed (step S301) and the internal timers are set (step S302), then in step S303 a check is made to determine whether or not the two-in-one mode has been selected for the document.

If a mode other than the two-in-one mode has been selected, the document control of step S304 is executed, whereas when the two-in-one mode has been selected the two-in-one mode control of step S306 is executed.

Other processes are executed in step S308, and the end of the internal timers are awaited in step S309. When the steps S302 through S309 are repeated and an interrupt request is received from the first CPU 201, the interrupt routine of step S311 executes communication with the first CPU 201.

Figure 29:
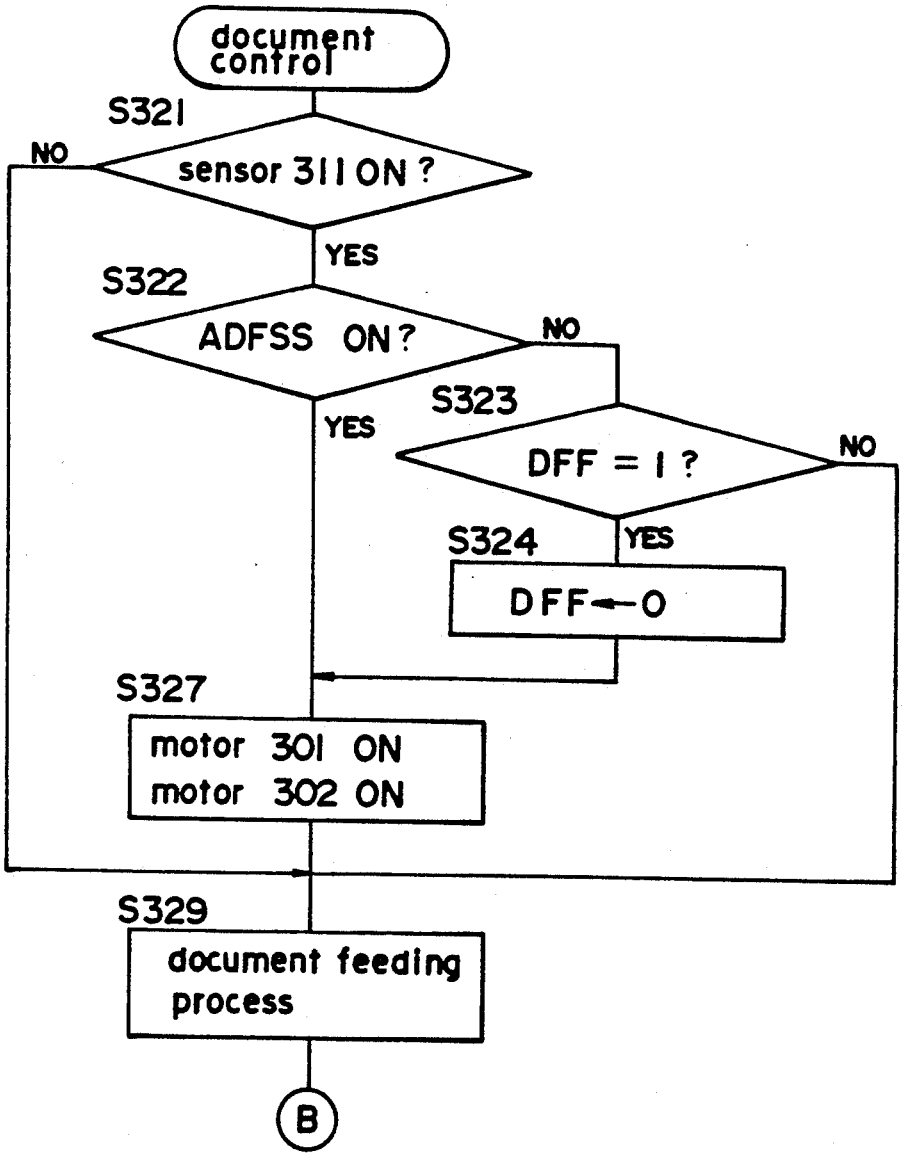
FIG. 29 is a part of a flow chart for the document control routine.
Figure 30:
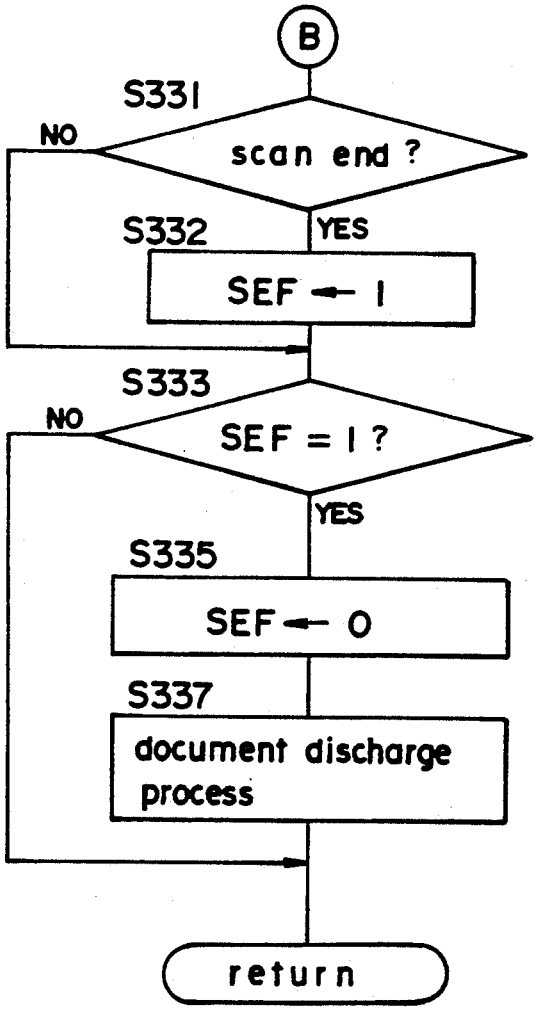
FIG. 30 is a part of a flow chart for the document control routine.

FIGS. 29 and 30 show a flow chart of the document control routine of the previously described step S304.

When the original document sensor 311 is ON, i.e., when an original is present in the document tray 303 (step S321), a check is made in step S322 to determine whether or not the ADF start signal ADFSS is ON.

When the reply to the query in step S322 is YES, the transport motor 301 is forward rotated in step S327 and the feed motor 302 is turned ON.

When the check made in the aforementioned step S322 determine that the ADF start signal ADFSS is OFF, a further check is made in step S323 to determine whether or not the document feed flag DFF is set at [1]. If the flag DFF is set at [1], said flag DFF is once set at [0] and the routine advances to step S327.

The step S329 is a document feeding process for placing an original document fed from the document tray 303 to a predetermined position on the glass document platen 16 via the ON/OFF switching of the transport motor 301 and feed motor 302 with a predetermined timing. Details of the aforesaid control are well known and are, therefore, omitted from the present description.

In step S331, a check is made to determine whether or not scanning has been completed for a predetermined number of sheets. If scanning is completed, the scan end flag SEF is set at [1] in step S332.

In step S333, the scan end flag SEF is checked and if said flag SEF is set at [1], said flag is then set at [0] in step S335, and the routine continues to step S337 where the document discharge process is executed.

In the document discharge process, the transport motor 301 is turned ON for a predetermined time to discharge the original disposed on the document platen 16 to the discharge tray 306. At the same time, when another original document is present on the document tray 303 the document feed flag DFF is set at [1].

Figure 31:
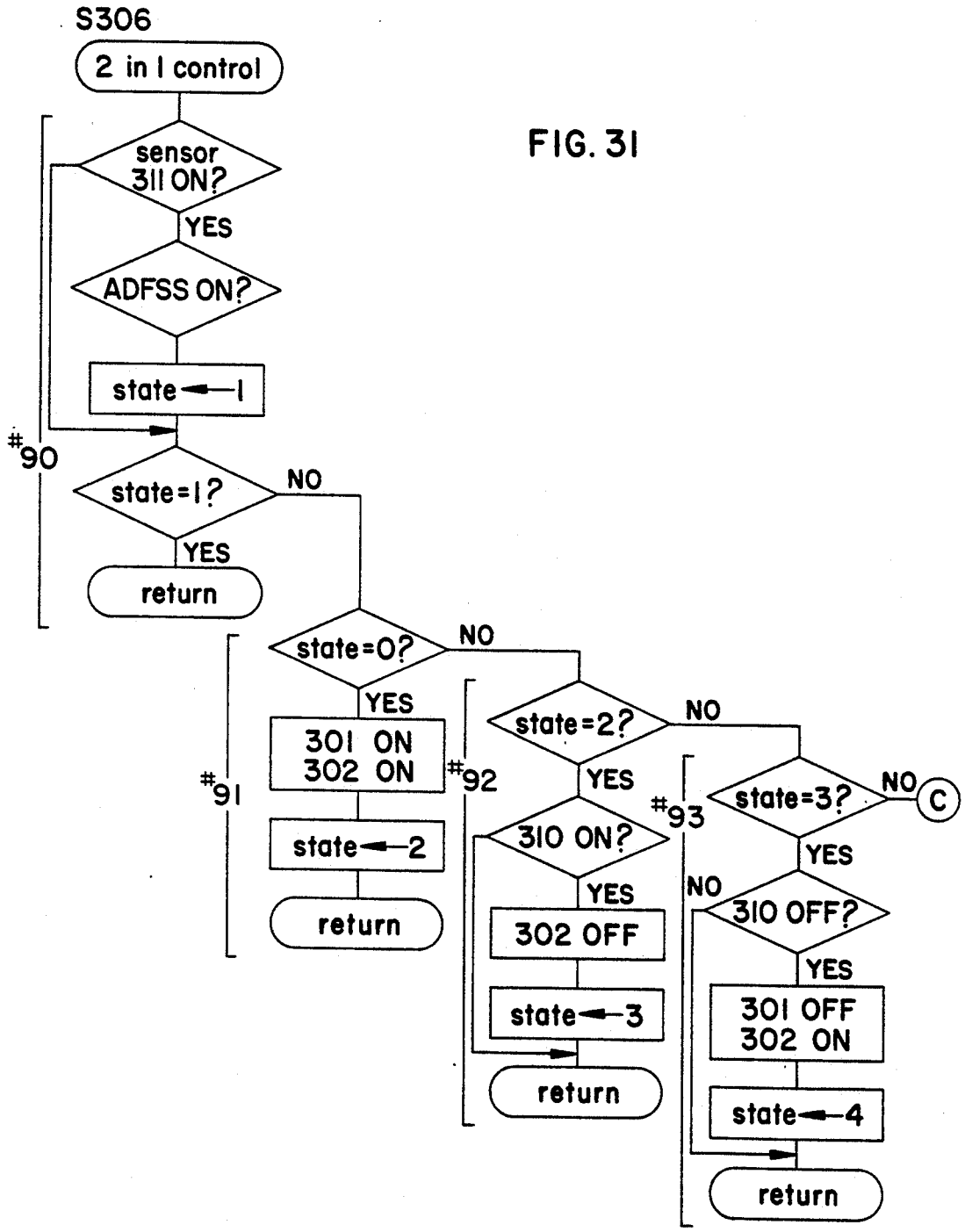
FIG. 31 is a part of a flow chart for the two-in-one mode control routine.
Figure 32:
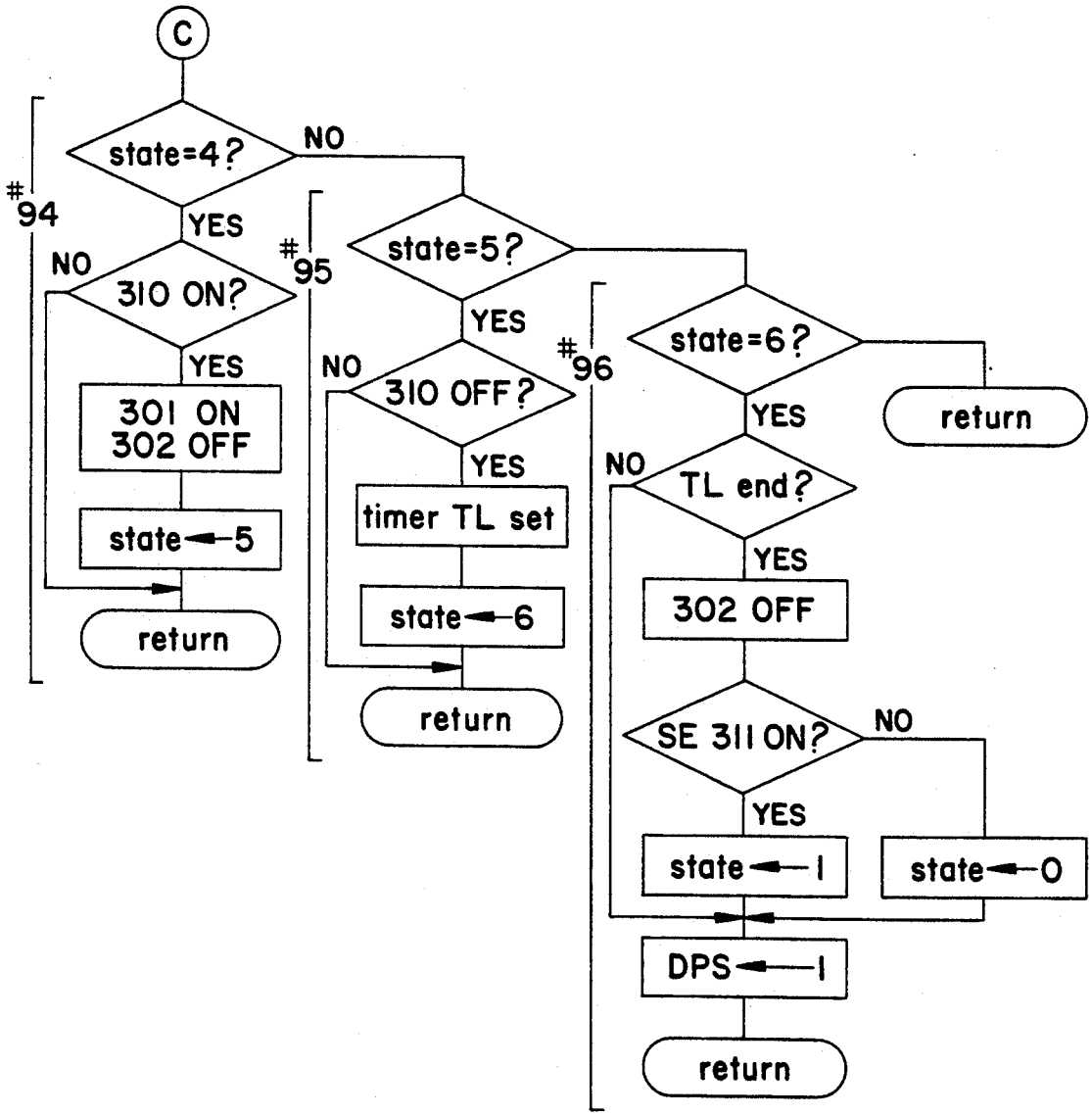
FIG. 32 is a part of a flow chart for the two-in-one mode control routine.

FIGS. 31 and 32 show a flow chart for the two-in-one mode control routine of step S306.

Figure 33:
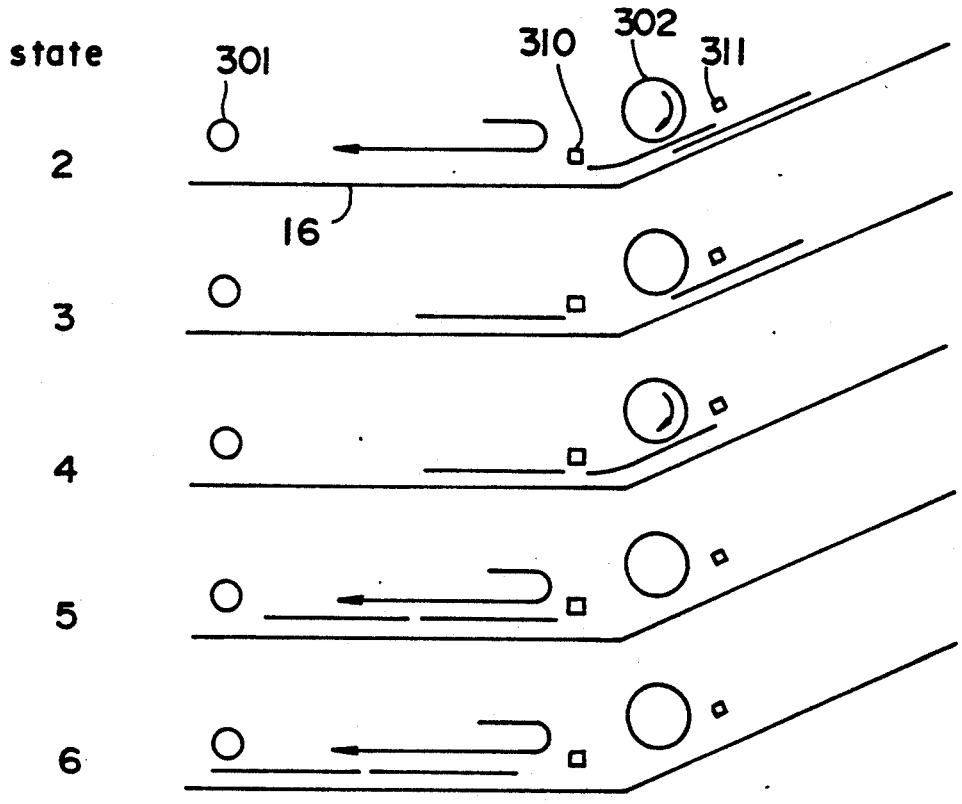
FIG. 33 is a construction view showing the document feed state in the two-in-one mode.
Figure 34:
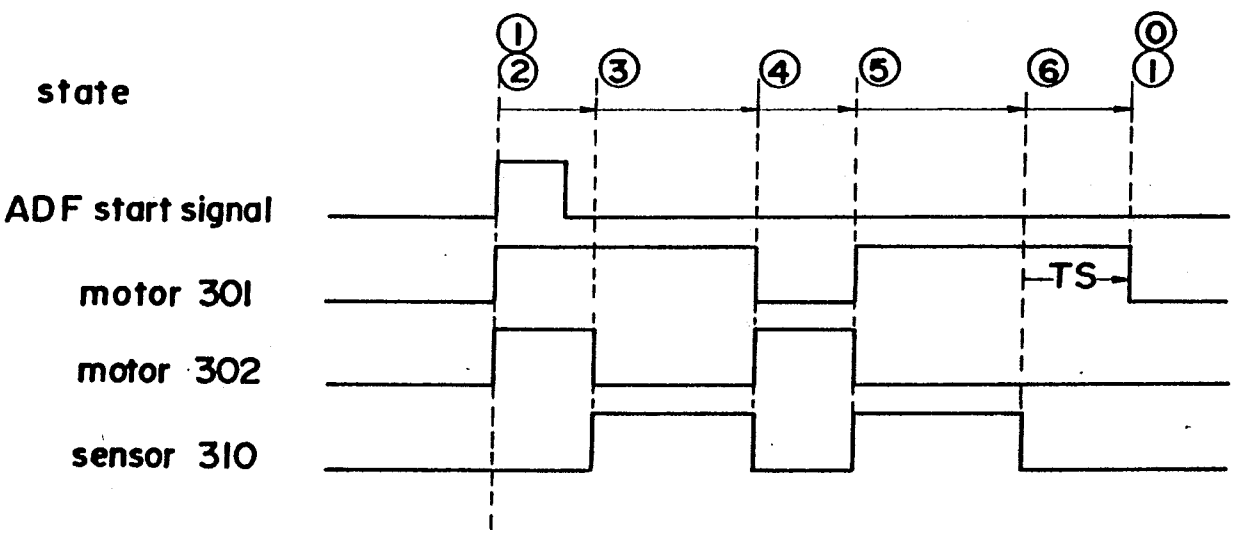
FIG. 34 is a timing chart showing the operation of the automatic document feeder.

The two-in-one mode control routine is a process for placing two original documents side by side on the document platen 16, and is accomplished via illustration of FIG. 33 showing the document transport state of the two-in-one mode and the ADF operation timing chart of FIG. 34.

In block 90 of FIG. 31, when a document is laced in the document tray 303, the ADF start signal is ON and the state is set at [1].

In state [1], the transport motor 301 and feed motor 302 are turned ON to start feeding a first original, then the state is set at [2] (block 91).

In state [2], when the feed sensor 310 is turned ON, that is, when the leading end of a first original document reaches the feed sensor 310, the feed motor 302 is turned OFF, but the document continues to be transported via a transport belt 304 driven by the transport motor 301. Then, the state is updated to [3] (block 92).

In state [3], when the feed sensor 310 is turned OFF, that is, when a first original document passes the feed sensor 310, the feed motor 301 is turned OFF so that the first document is stopped in the document platen 16, then feed motor 302 is turned ON and a second original document is fed. Then the state is updated to [4] (block 93).

In state [4], when the leading end of the second document reaches the feed sensor 310, the feed sensor is turned ON, and the transport motor 301 is turned ON to start simultaneously feeding the first and second original documents.

When the feed motor 302 is turned OFF, the state is updated to [5] (block 94).

In state [5], when the feed sensor 310 is turned OFF, the timer TL is set, and the state is updated to [6]. The timer TL is set with a value to allow the trailing end of the original document to reach a set position on the document platen 16, i.e., to reach the scan start position (block 95).

In state [6], the transport motor is turned OFF when the timer TL ends. Thus, the first and second original documents are positioned side by side at a set position on the document platen 16 for the scanning of the copy process.

At this point in time, when a next document is present on the document tray 303, the state is reset at [1], whereas the state is reset at [0] when a next document is not present in the document tray 303. Thereafter, a document position signal DPS is set at [1] and transmitted to the first CPU 201 (block 96).

The first CPU 201 starts the original document scanning operation when a document position signal is received.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

Although in the present embodiment a ten-key pad is used to input the number of original document, the invention is not limited to said means inasmuch as, for example, an ADF may be used for said input. More specifically, when the page mode is selected the ADF count mode operation is executed. The count mode counts the number of original documents set in the document tray 303 by using the sensors 310 or 313 to count said documents as they are transported from the document ray 303 to the discharge tray 306 in the absence of an accompanying copy operation. In the count mode, the number of the counted documents is stored in the RAM 203. After the original documents have been counted, said document are moved from the discharge tray 306 to the document tray 302 and the copying operation is started. The ADF may be a circulating type ADF such as is disclosed in U.S. Pat. No. 5,041,874, i.e., an ADF using an RDF which returns the original documents fed from the document tray back to the same document tray, so that after the counting operation of the count mode, the original document need not be reset manually in the document tray.

In the present embodiment, the two-in-one mode was used as an example of a composite copy wherein two original documents are placed side by side on the document platen and copied onto a single surface of a copy sheet in a single copy operation, but the present invention is not limited to said mode inasmuch as, for example, the images of two original documents may be copied side by side onto a single surface of a copy sheet via two copy operation such as is disclosed in U.S. Pat. No. 4,831,413. That is, the image of a first original document set on the document platen is copied onto one-half the area of a copy sheet in a first copy operation after which the first document is discharged, and the image of a second document placed on the document platen is copied onto the remaining one-half area of the same copy sheet in a second copy operation. The data modes and controls described in the present embodiment of the invention may also be used for the aforesaid type of composite copy.

What is claimed is:

1. An image forming apparatus comprising:

a platen on which an original document is placed;

original image forming means for forming an image of the original document placed on the platen on a copy sheet, said original image forming means including a multiple image forming mode in which a plurality of images of original documents are formed on different sections of a single surface of a copy sheet;

additional data image forming means for forming a plurality of additional data images at different positions onto the same surface of the copy sheet on which said plurality of images of original documents are formed; and control means for controlling said additional data image forming means so that each of said additional data images may correspond to any one of said plurality of images of the original documents one to one.

2. An image forming apparatus as claimed in claim 1, wherein said original image forming means includes:

photosensitive member;

illuminating means for illuminating an original document placed on the platen; and optical system for exposing said photosensitive member to an image of the original document illuminated by said illuminating means;

said additional data image forming means includes:

memory which stores data corresponding to the additional data images;

light emitting means for selectively emitting light in accordance with the data sorted in the memory.

3. An image forming apparatus comprising:

a platen on which an original document is placed;

original image forming means for forming an image of the original document placed on the platen on a copy sheet, said original image forming means including a multiple image forming mode in which a plurality of images of original documents are formed on a single surface of a copy sheet; and additional data image forming means for forming a plurality of additional data images at different positions onto the same surface of the copy sheet on which said plurality of images of original documents are formed, each of said additional data images corresponding to one of said images of the original documents;

said original image forming means includes;

a photosensitive member;

illuminating means for illuminating an original document placed on the platen; and an optical system for exposing said photosensitive member to an image of the original document illuminated by said illuminating means; said additional data image forming means includes;

a memory which stores data corresponding to the additional data images;

light emitting means for selectively emitting light in accordance with the data stored in the memory;

wherein said additional image forming means is capable of placing the additional data images at different places on a copy sheet.

4. An image forming apparatus as claimed in claim 3, wherein said additional data image forming means changes the places of additional data images in accordance with the size of the copy sheet on which said additional data images are formed.

5. An image forming apparatus as claimed in claim 4, further comprising:

original feeding means for feeding and setting first and second documents on said platen side by side.

6. An image forming apparatus as claimed in claim 5, wherein said image forming means forms images of said first and second documents set by said original feeding means on a single surface of the copy sheet side by side; and said additional data image forming means forms a first additional image corresponding to said first document at a first place on the copy sheet and forms a second additional image corresponding to a second document at a second place on the copy sheet.

7. An image forming apparatus comprising:

platen on which an original document is placed;

original image forming means for forming an image of a first original document placed on the platen and an image of a second original document placed on the platen onto a single surface of a copy sheet side by side, the image of the first original document formed in a first half area of the surface of the copy sheet and the image of the second original document formed in a second half area of the surface of the copy sheet; and additional data image forming means for forming a first additional data image in the first half area of the copy sheet and forming a second additional data image in the second half area of the copy sheet.

8. An image forming apparatus as claimed in claim 7, wherein said first additional data image and said second additional data image are the same.

9. An image forming apparatus as claimed in claim 8, wherein said first additional data image and said second additional data image represent the dates of the copy.

10. An image forming apparatus as claimed in claim 9, wherein said additional data image forming means includes a clock which generates date information.

11. An image forming apparatus as claimed in claim 7, wherein said first additional data image and said second additional data image are different from each other.

12. An image forming apparatus as claimed in claim 11, wherein said first additional data image and said second additional data image represent consecutive page numbers.

13. An image forming apparatus as claimed in claim 12, wherein said additional data image forming means includes:

number input means for inputting a number of documents to be copied;

memory which stores the number input by said input means;

means for renewing the number stored in said memory in response to the operation of said additional data image forming means; and wherein said additional data image forming means forms additional data images based on the data stored in the memory.

14. An image forming apparatus comprising:

platen which is capable of supporting at least two original documents side by side;

original document feeding means for feeding a first original document and a second original document successively and setting them side by side on the platen;

original image forming means for forming an image of the first original document and an image of the second original document placed on the platen onto a single surface of a copy sheet side by side, the image of the first original document formed in a first half area of the surface of the copy sheet and the image of the second original document formed in a second half area of the surface of the copy sheet; and additional data image forming means for forming a first additional data image in the first half area of the copy sheet and forming a second additional data image in the second half area of the copy sheet.

15. An image forming apparatus as claimed in claim 14, wherein said original document feeding means includes a document stacking portion on which a plurality of original documents are stacked, and said feeding means drawing a pair of documents from the stack and feeds them to the platen.

16. An image forming apparatus as claimed in claim 15, wherein said first additional data images and said second additional data images represent the date of the copy.

17. An image forming apparatus as claimed in claim 16, wherein said additional data image forming means includes a clock which generates date information.

18. An image forming apparatus as claimed in claim 15, wherein said first additional data image and said second additional data image represent consecutive page numbers.

19. An image forming apparatus as claimed in claim 18, wherein said additional data image forming means includes:

number input means for inputting the number of documents to be copied;

memory which stores the number input by said input means;

means for renewing the number stored in said memory in response to the operation of said additional data image forming means; and wherein said additional data image forming means forms additional data images based on the data stored in the memory.

20. An image forming apparatus comprising:

platen on which an original document is placed;

mode selecting means for selecting one of either a first mode or second mode;

original image forming means for forming an image of the original document placed on the platen on a copy sheet, said original image forming means forms a single image on a single surface of a copy sheet in a first mode and forms a plurality of original document images on a single surface of a copy sheet in a second mode; and additional data image forming means for forming an additional data image on the same surface of a copy sheet on which the image is formed by said additional image forming means, said original image forming means forms a single additional data image in the first mode and forms a plurality of additional data images at different positions corresponding to the images of the original document in the second mode.

* * * * *